US010351383B2

(12) United States Patent
Saito et al.

(10) Patent No.: US 10,351,383 B2
(45) Date of Patent: Jul. 16, 2019

(54) SHEET POST-PROCESSING APPARATUS AND IMAGE FORMATION SYSTEM USING THE APPARATUS

(71) Applicants: Takashi Saito, Yamanashi-ken (JP); Minori Furiya, Yamanashi-ken (JP)

(72) Inventors: Takashi Saito, Yamanashi-ken (JP); Minori Furiya, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 216 days.

(21) Appl. No.: 14/319,665

(22) Filed: Jun. 30, 2014

(65) Prior Publication Data

US 2015/0014916 A1 Jan. 15, 2015

(30) Foreign Application Priority Data

Jul. 12, 2013 (JP) ..... 2013-146633

(51) Int. Cl.

| | |
|---|---|
| ***B65H 31/36*** | (2006.01) |
| ***B65H 31/30*** | (2006.01) |
| ***B65H 31/34*** | (2006.01) |
| ***B65H 31/38*** | (2006.01) |
| ***B65H 9/00*** | (2006.01) |

(52) U.S. Cl.

CPC ..... *B65H 31/36* (2013.01); *B65H 9/002* (2013.01); *B65H 31/3018* (2013.01); *B65H 31/34* (2013.01); *B65H 31/38* (2013.01); *B65H 2220/09* (2013.01); *B65H 2301/4213* (2013.01); *B65H 2405/11425* (2013.01); *B65H 2511/11* (2013.01); *B65H 2511/20* (2013.01); *B65H 2513/10* (2013.01); *B65H 2801/27* (2013.01)

(58) Field of Classification Search

CPC ..... B65H 2511/414; B65H 2511/415; B65H 2701/1315; B65H 31/36; B65H 31/34

USPC ..... 271/221

See application file for complete search history.

(56) References Cited

U.S. PATENT DOCUMENTS 6,357,743 B1 * 3/2002 Endo ..... B42C 1/12 271/296
7,389,980 B2 * 6/2008 Kushida ..... B65H 9/06 270/58.12

(Continued)

FOREIGN PATENT DOCUMENTS

JP 2011-126620 A 6/2011
JP 2012-188194 A 10/2012

*Primary Examiner* — Patrick Cicchino
(74) *Attorney, Agent, or Firm* — Manabu Kanesaka

(57) ABSTRACT

To effectively correct a sheet that is transported while being skewed, a post-processing apparatus B provided with a processing tray 25 that temporarily stores a sheet to perform post-processing and a stack tray 30 that loads sheets subjected to the post-processing performs preliminary alignment with one of an alignment mechanism 35 on the processing tray 25 side and an alignment mechanism 38 on the stack tray 30 side corresponding to size information of a sheet in transporting the sheet from the stack tray 30 side toward the processing tray 25 for post-processing in a post-processing device 31, and takes in the sheet toward a regulation stopper 29 with a take-in roller 33. Then, after aligning the sheet with the alignment mechanism 35, the apparatus performs the post-processing on the sheet with the sheet post-processing device 31 to transport to the stack tray 30.

24 Claims, 19 Drawing Sheets

(56) References Cited

U.S. PATENT DOCUMENTS

| | | | | |
|---|---|---|---|---|
| 7,862,025 | B2 * | 1/2011 | Sugizaki | B42C 1/125 270/58.07 |
| 7,918,450 | B2 * | 4/2011 | Yoshida | B65H 29/14 270/58.11 |
| 8,087,654 | B2 * | 1/2012 | Awano | B65H 31/20 270/58.07 |
| 8,146,909 | B2 * | 4/2012 | Kuno | B65H 31/3081 270/58.27 |
| 8,326,208 | B2 * | 12/2012 | Tamura | B65H 29/14 271/213 |
| 8,398,067 | B2 * | 3/2013 | Furuhashi | B42C 1/125 270/58.07 |
| 8,540,229 | B2 * | 9/2013 | Tsuji | G03G 15/6541 270/58.12 |
| 8,651,480 | B2 * | 2/2014 | Watanabe | B65H 31/26 271/221 |
| 8,720,880 | B2 * | 5/2014 | Awano | B65H 31/38 270/58.07 |
| 8,882,106 | B2 * | 11/2014 | Maenishi | B26D 7/015 270/58.07 |
| 2015/0003939 | A1 * | 1/2015 | Abe | B65H 37/04 412/33 |
| 2015/0180392 | A1 * | 6/2015 | Taguchi | 271/234 |
| 2015/0183606 | A1 * | 7/2015 | Nishi | B65H 31/02 271/234 |

* cited by examiner

SHEET POST-PROCESSING APPARATUS AND IMAGE FORMATION SYSTEM USING THE APPARATUS

BACKGROUND OF THE INVENTION

Technical Field

The present invention relates to a sheet post-processing apparatus which temporarily stores image-formed sheets in a processing tray to perform post-processing such as binding processing and then stores in a stack tray.

Description of the Related Art

Generally, this type of sheet post-processing apparatus is widely used as an apparatus which is coupled to a sheet discharge outlet of an image formation apparatus, collates and stores discharged sheets on a processing tray to perform post-processing such as binding processing, folding processing, punching processing and stamping processing, and then stores the processed sheets (bunch) in a stack tray prepared on the downstream side.

Then, such a post-processing apparatus is known that a processing tray and a stack tray are arranged next to each other in a sheet discharge outlet of an image formation apparatus, a rear end portion of a sheet transported from the sheet discharge outlet is supported on the processing tray, a front end portion of the sheet is supported on the uppermost sheet on the stack tray, the sheet is thereby held with the front and rear partially supported, and that a bunch of sheets collated on the processing tray is subjected to binding processing with a staple apparatus (for example, see Japanese Patent Application Publication No. 2011-126620). Such a post-processing mechanism that bridge-supports a sheet transported from the sheet discharge outlet on the processing tray and the stack tray on the downstream side thereof is widely adopted because it is possible to miniaturize the apparatus.

In the apparatus in Japanese Patent Application Publication No. 2011-126620, a height difference is formed from the sheet discharge outlet to arrange the processing tray that supports the sheet rear end portion, and another height difference is formed on the downstream side of the processing tray to arrange the stack tray that supports the sheet front end portion. Then, a pair of right and left alignment device for supporting side edge portions of the sheet are provided above the stack tray to align the sheet in a post-processing position on the processing tray, the sheet is positioned in the processing position by a shifting the alignment device from retracted positions retracted from reference positions (center reference) to the reference positions (alignment positions), and sheets are subjected to post-processing on the processing tray. It is configured that after the post-processing, the alignment members are shifted to the side of the sheets, and that the sheets subjected to the post-processing are dropped into the stack tray to store.

In the post-processing apparatus for thus holding the sheet in the shape of a bridge in cooperation between the processing tray and the stack tray on the downstream side thereof, such a configuration is also known that alignment members are provided on both the processing tray and the stack tray (for example, see Japanese Patent Application Publication No. 2012-188194).

OBJECT OF THE INVENTION

In the sheet post-processing apparatus provided with the alignment device in each of the processing tray and the stack tray as shown in Japanese Patent Application Publication No. 2012-188194, the sheet transported onto the processing tray is aligned from the width direction of the sheet by the alignment device provided in the processing tray, then the front end of the switch-backed sheet strikes a reference fence, and the position of the sheet is thereby aligned in the transport direction. At this point, for alignment in the width direction of the sheet, in the case of a long sheet, since the sheet is also laid on the stack tray, as well as alignment operation by the alignment device provided in the processing tray, alignment of the sheet is performed also with the alignment device of the stack tray.

However, since the long sheet is long in a dimension in the transport direction of the sheet, when the sheet is discharged from the sheet discharge outlet and is transported, the sheet is sometimes transported in a state in which the sheet is deviated in the transport direction i.e. so-called the skewed state, or is sometimes already skewed in a state in which the sheet is discharged from the sheet discharge outlet. When the sheet is guided to the processing tray in such a skewed state, in the case where the degree of misregistration is large, as shown in FIG. 21, a corner portion of the front end of the sheet in the transport direction comes into contact with the alignment device of the processing tray and buckles, and a malfunction such as a jam occurs.

The present invention was made in view of the above-mentioned respect, and is to provide a sheet post-processing apparatus, which is provided with an alignment device in both the processing tray and the stack tray, for enabling a sheet that is transported while being skewed to be effectively corrected when the alignment device perform alignment operation in cooperation with each other, and an image formation system using the apparatus.

BRIEF SUMMARY OF THE INVENTION

To attain the above-mentioned object, a post-processing apparatus according to the present invention is provided with a sheet discharge path having a sheet discharge outlet, a transporter for transporting a sheet along the sheet discharge path, a processing tray to perform post-processing on the sheet transported from the sheet discharge outlet, a regulation stopper that regulates an end portion in a transport direction of the sheet transported to the processing tray, a sheet take-in device for taking in the sheet transported onto the processing tray toward the regulation stopper, a first alignment device for aligning the sheet, which is transported from the sheet discharge outlet onto the processing tray, in a direction orthogonal to the transport direction of the sheet, a second alignment device disposed on the downstream side of the first alignment device in the transport direction of the sheet to align the sheet, which is transported from the sheet discharge outlet onto the processing tray, in the direction orthogonal to the transport direction of the sheet, a sheet post-processing device for performing predetermined post-processing on the sheet aligned in the transport direction of the sheet and the direction orthogonal to the transport direction of the sheet on the processing tray, a discharger for discharging the sheet from the processing tray, a stack tray that collects the sheet subjected to the post-processing on the processing tray with the discharger, and a controller for controlling operation of the first alignment device and the second alignment device, where in driving the sheet take-in device, the controller causes one of the first alignment device and the second alignment device to perform preliminary alignment operation that is alignment with a distance longer than a dimension in a width direction of the sheet corresponding to size information of the sheet transported to the processing tray from the sheet discharge outlet. Herein, for example, the post-processing device is a staple unit that performs binding processing on sheets loaded on the processing tray.

Then, after the sheet that is transported to the processing tray arrives at the regulation stopper, the controller causes the first alignment device to perform alignment operation that is alignment with a distance substantially equal to the dimension in the width direction of the sheet.

At this point, a transport speed by the transporter is capable of being switched to a high-speed transport mode, and in the high-speed transport mode, when shifting the second alignment device to the preliminary alignment position, the controller makes the second alignment device a receiving state capable of receiving the sheet in carrying the sheet in the processing tray.

Thus, as timing for making the second alignment device the sheet receiving state, it is preferable to perform after the first alignment device finishes the alignment operation of the sheet, after the sheet take-in device starts transport operation of the sheet toward the regulation stopper, in accordance with the alignment operation of the sheet by the first alignment device, or after the post-processing device finishes post-processing operation.

After causing the first alignment device to perform the alignment operation, the controller causes the second alignment device to perform the alignment operation.

At this point, the controller may cause the second alignment device to perform the alignment operation in accordance with the first alignment device, after the sheet that is transported to the processing tray arrives at the regulation stopper.

Further, the controller may cause the first alignment device to perform the alignment operation after causing the second alignment device to perform the alignment operation.

In discharging the sheet to the stack tray, the controller makes the second alignment device the receiving state.

Then, after making the second alignment device the receiving state, the controller makes the first alignment the receiving state.

Further, after causing the second alignment device to perform the preliminary alignment operation, the controller causes the first alignment device to perform the preliminary alignment operation.

The first alignment device is provided with a pair of right and left alignment plates at least one of which shifts to positions in the sheet width direction orthogonal to the transport direction of the sheet.

Further, the second alignment device is provided with a pair of right and left alignment members at least one of which shifts to positions in the sheet width direction orthogonal to the transport direction of the sheet, and each of the alignment members has a sheet support surface that supports a lower surface of the sheet transported from the sheet discharge outlet to the processing tray, and a side regulation surface that aligns a side end surface of the sheet carried onto the processing tray in a predetermined processing position.

Then, the apparatus is provided with height-direction shift device for moving at least one of the alignment members up and down in a height direction, and the controller controls the height-direction shift device so that the sheet support surface is in a first height position in carrying the sheet from the sheet discharge outlet into the processing tray, and that the sheet support surface is in a second height position in carrying the sheet from the processing tray to the stack tray.

At this point, the sheet support surface supports the sheet in a height posture almost the same as a paper mount surface of the processing tray in the first height position, and supports the sheet in a curved posture downward from the paper mount surface of the processing tray in the second height position.

On the other hand, the alignment members are axially supported swingably between the first and second height positions. Then, the alignment members are configured to be able to move up and down corresponding to a load amount of an uppermost sheet on the stack tray so as to press a surface of the uppermost sheet on the stack tray in a state of the first height position.

Further, the controller controls the height-direction shift device, and enables the alignment members to shift to a third height position retracted from any shift trajectory of the sheet which is transported from the sheet discharge outlet to the processing tray or which is transported from the processing tray to the stack tray.

An image formation system according to the present invention is comprised of an image formation apparatus that forms an image on a sheet, and the above-mentioned sheet post-processing apparatus that performs post-processing on the sheet transported from the image formation apparatus to store in the stack tray.

BRIEF DESCRIPTION OF THE SEVERAL VIEWS OF THE DRAWINGS

FIG. 6A is an explanatory view of the configuration, and FIG. 6B is an explanatory view of a position relationship of an alignment member;

DETAILED DESCRIPTION OF THE INVENTION

[Image Formation System]

Figure 1:
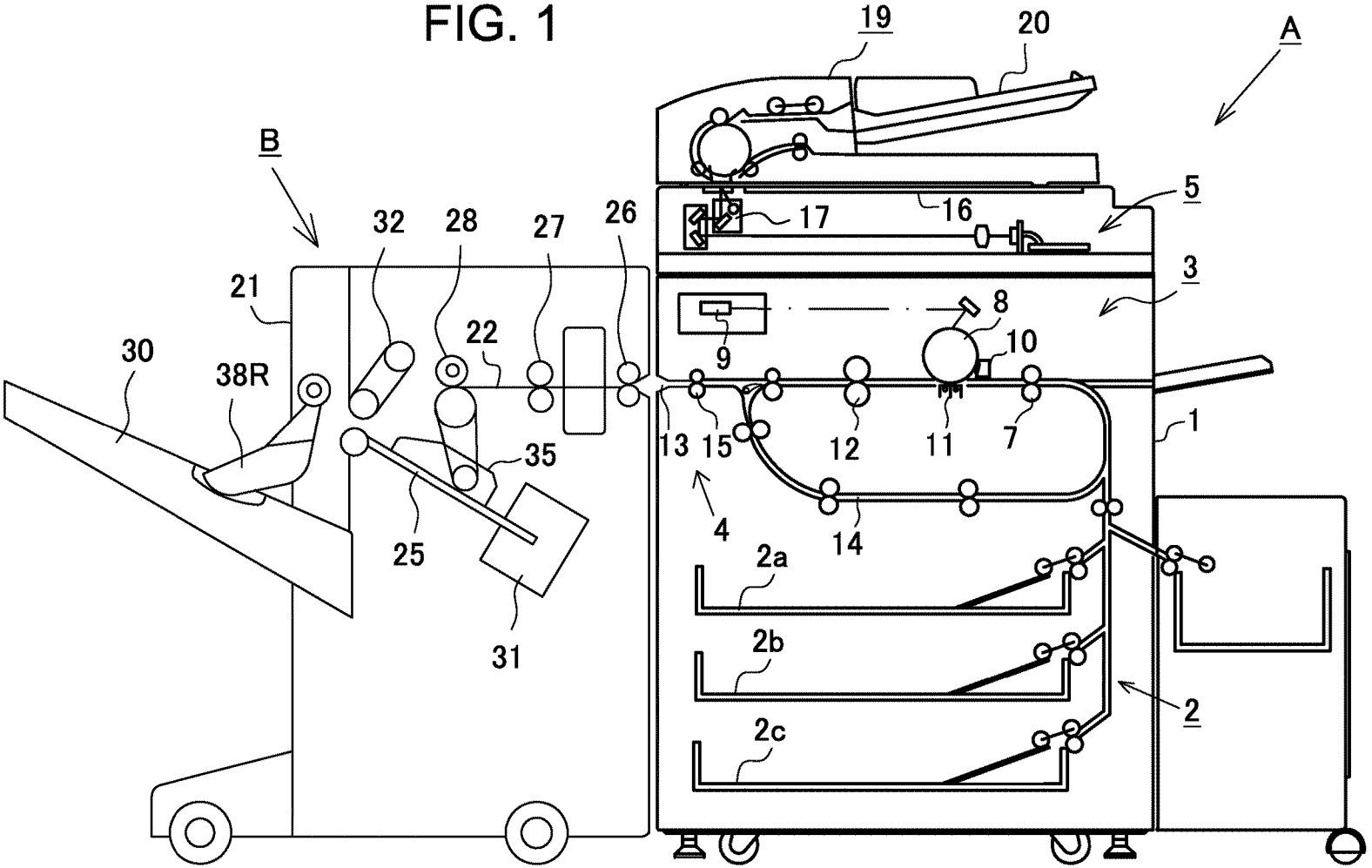
FIG. 1 is a view schematically showing the entire configuration of an image formation system.

FIG. 1 illustrates the entire configuration of an image formation system according to the present invention. The image formation system in FIG. 1 is comprised of an image formation apparatus A and post-processing apparatus B, and sheets with images formed in the image formation apparatus A are temporarily collated, stored, staple-bound in the post-processing apparatus B, and then, are stored in a stack tray. Then, by setting a post-processing (finish processing) mode together with image formation conditions in the image formation apparatus A, the post-processing apparatus B is configured to perform the finish processing corresponding to the set post-processing mode and then store sheets in the stack tray. The image formation apparatus A and post-processing apparatus B will be described below.

[Image Formation Apparatus]

The image formation apparatus A shows the case where an image is formed on a sheet by an electrostatic printing mechanism, and is comprised of a paper feed section 2, image formation section 3, and sheet discharge section 4. The paper feed section 2 that stores sheets to form an image is incorporated into an apparatus housing 1, is detachable and attachable with respect to the housing 1, and is comprised of paper cassettes 2*a*, 2*b* and 2*c*, and the paper cassettes 2*a*, 2*b* and 2*c* correspond to respective sheet sizes.

The image formation section 3 forms an image on a sheet transported from the paper feed section 2 according to image data transferred from a data processing section 9. The image formation section 3 as shown in FIG. 1 shows the electrostatic printing mechanism, and is comprised of a beam projector that forms an electrostatic latent image on a photoconductor drum 8, a development device 10 that adds toner ink to the electrostatic latent image, a transfer charger 11, and a cleaner. The specific configurations and operation of these members are widely known, and therefore, the detailed description is omitted.

Then, the transfer charger 11 transfers the image ink formed on the photoconductor drum 8 to the sheet transported to a register roller 7 from the paper feed section 2. A fuse roller 12 is disposed on the downstream side of the transfer charger 11, and heats and fuses the image on the sheet to transport to the sheet discharge section 4. The sheet discharge section 4 is comprised of a sheet discharge outlet 13 and sheet discharge roller 15 disposed in the apparatus housing 1.

The data processing section 9 transmits image data read by an image read unit 5, or image data sent from an external network, computer input apparatus or the like to the beam projector as an electric signal corresponding to the set image formation conditions.

The apparatus shown in FIG. 1 is provided with the image read unit 5 integrated with the image formation apparatus A, and an automatic document feeder 19 that feeds a document sheet to the unit. The image read unit 5 is comprised of platen 16 to mount the document sheet, and a read carriage 17 that shifts along the platen, and is formed of a scanner apparatus that scans the document on the platen 16 with the carriage to convert into image data. Further, the automatic document feeder 19 is integrally attached to the image read unit 5 as a unit that automatically feeds documents set in a paper feed tray 20 to the platen 16. A duplex path 14 reverses the side of the image-formed sheet from the image formation section 3 to circulate and transport to the register roller 7, an image is formed on the backside of the sheet in the image formation section 3, and the sheet is carried out from the sheet discharge section 4 to the main-body sheet discharge outlet 13.

As well as the above-mentioned electrostatic printing mechanism, the image formation apparatus A is capable of adopting various image formation mechanisms such as an inkjet image formation scheme, offset printing scheme and silk printing scheme.

[Post-Processing Apparatus]

As shown in FIG. 1, when an image-formed sheet transported from the image formation apparatus A is carried in, after collating and storing sheets on a processing tray 25, the post-processing apparatus B according to the present invention performs finish post-processing (staple binding processing, jog dividing processing, folding processing and the like), and stores the processed sheets (bunch) in a stack tray 30.

Figure 2:
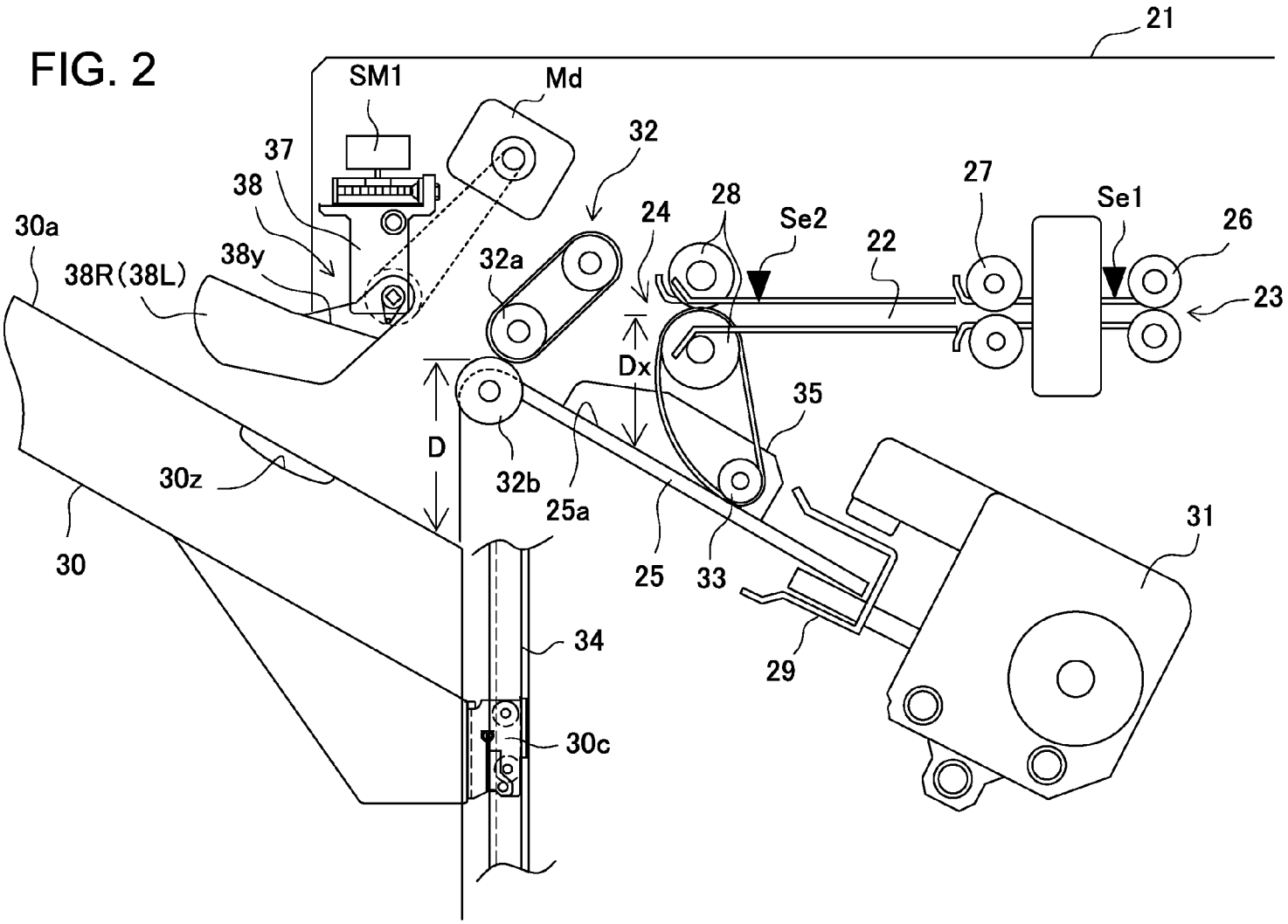
FIG. 2 is a side elevational view illustrating a configuration of principal part of a sheet post-processing apparatus in the system of FIG. 1.

FIG. 2 illustrates details of the post-processing apparatus B, and the apparatus B is comprised of an apparatus housing 21, a sheet discharge path 22 disposed in the housing, the processing tray 25 that temporarily stores sheets transported from the sheet discharge path 22, and the stack tray 30 that loads and stores the sheets subjected to post-processing.

The post-processing apparatus B according to the present invention will be described below.

[Sheet Discharge Path]

The sheet discharge path 22 is formed linearly in the approximately horizontal direction across the apparatus housing 21, is provided on the entrance side with a carry-in entrance 23 coupled to the main-body sheet discharge outlet 13 of the image formation apparatus A, and is configured to guide a sheet transported from the image formation apparatus A to the processing tray 25.

The sheet discharge path 22 is provided with a transporter constructed by arranging a carry-in roller 26, transport roller 27 and sheet discharge roller 28 sequentially, and not shown in FIG. 2, the device is coupled to a roller drive motor 53 (see FIG. 13) to transport the sheet from the carry-in entrance 23 toward a sheet discharge outlet 24. Further, in the sheet discharge path 22 are disposed a carry-in sensor Se1 on the carry-in entrance side and a sheet discharge sensor Se2 on the sheet discharge outlet side, and when these sensors detect a front end and rear end of the sheet, respectively, each sensor outputs a detection signal to a controller CPU 50 (see FIG. 13) described later.

[Processing Tray]

The processing tray 25 is disposed on the downstream side of the sheet discharge outlet 24 below with a height difference Dx formed. The processing tray 25 is provided with a paper mount 25*a* that supports the rear end portion in a discharge direction of the sheet, and is disposed to bridge-support the sheet transported from the sheet discharge outlet 24 with the stack tray 30 in the approximately horizontal direction.

In the processing tray 25 is disposed a regulation stopper 29 that regulates the position of the rear end portion in the discharge direction (direction of the right to left as viewed in FIG. 2) of the sheet and a post-processing device 31. Accordingly, the sheet discharged from the sheet discharge path 22 is reversely transported in the direction (rightward in FIG. 2) opposite to the direction in which the sheet is discharged, and is stored in the processing tray 25 disposed below the sheet discharge outlet 24. The post-processing device 31 is comprised of a staple unit, and performs binding processing on a sheet bunch loaded and collated on the paper mount 25*a* by reverse transportation with a staple. The staple unit is the well-known unit that has conventionally been adopted.

[First Alignment Device]

Figure 3:
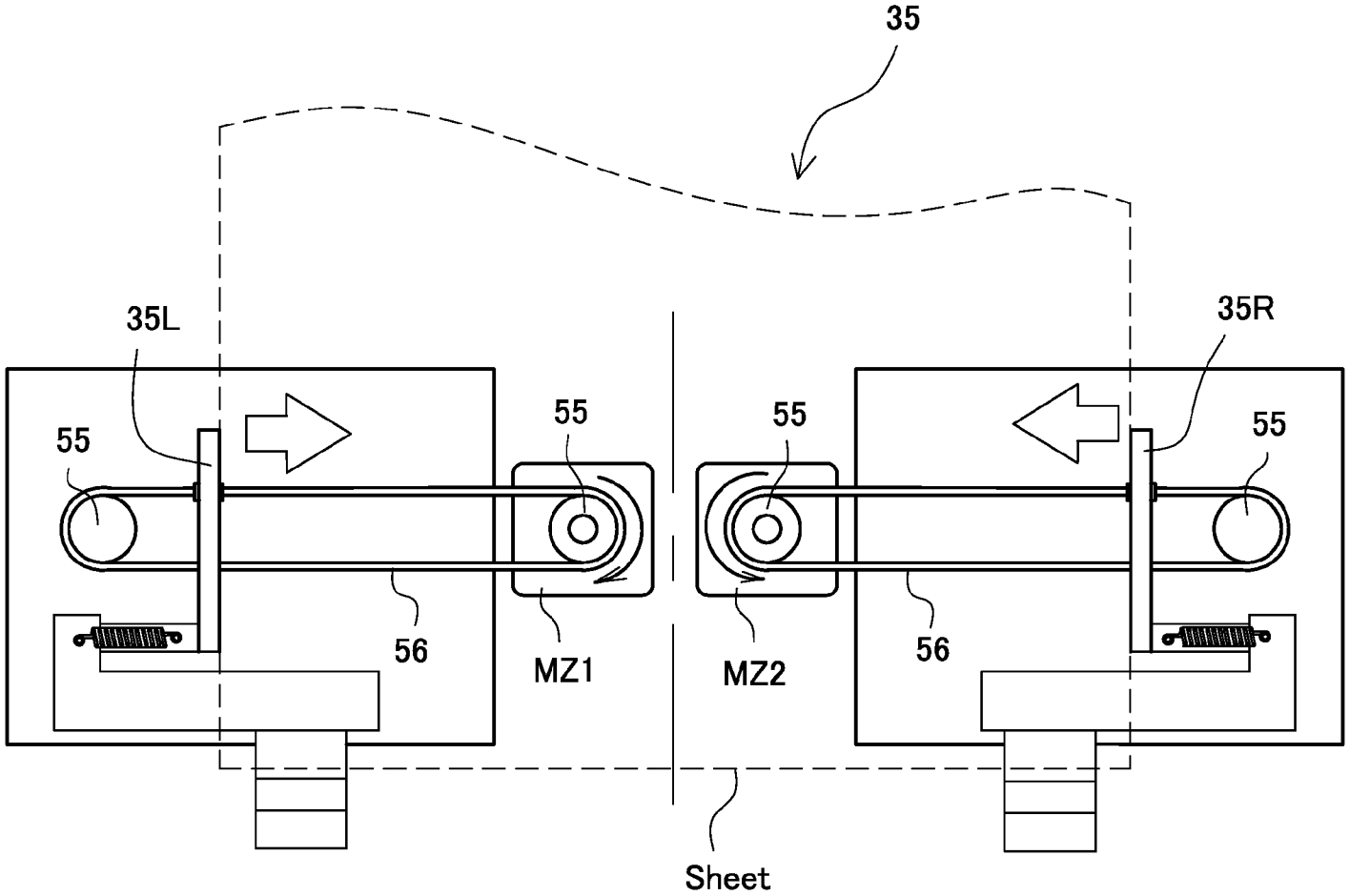
FIG. 3 is a plan view illustrating a configuration of a first alignment device.
Figure 20:
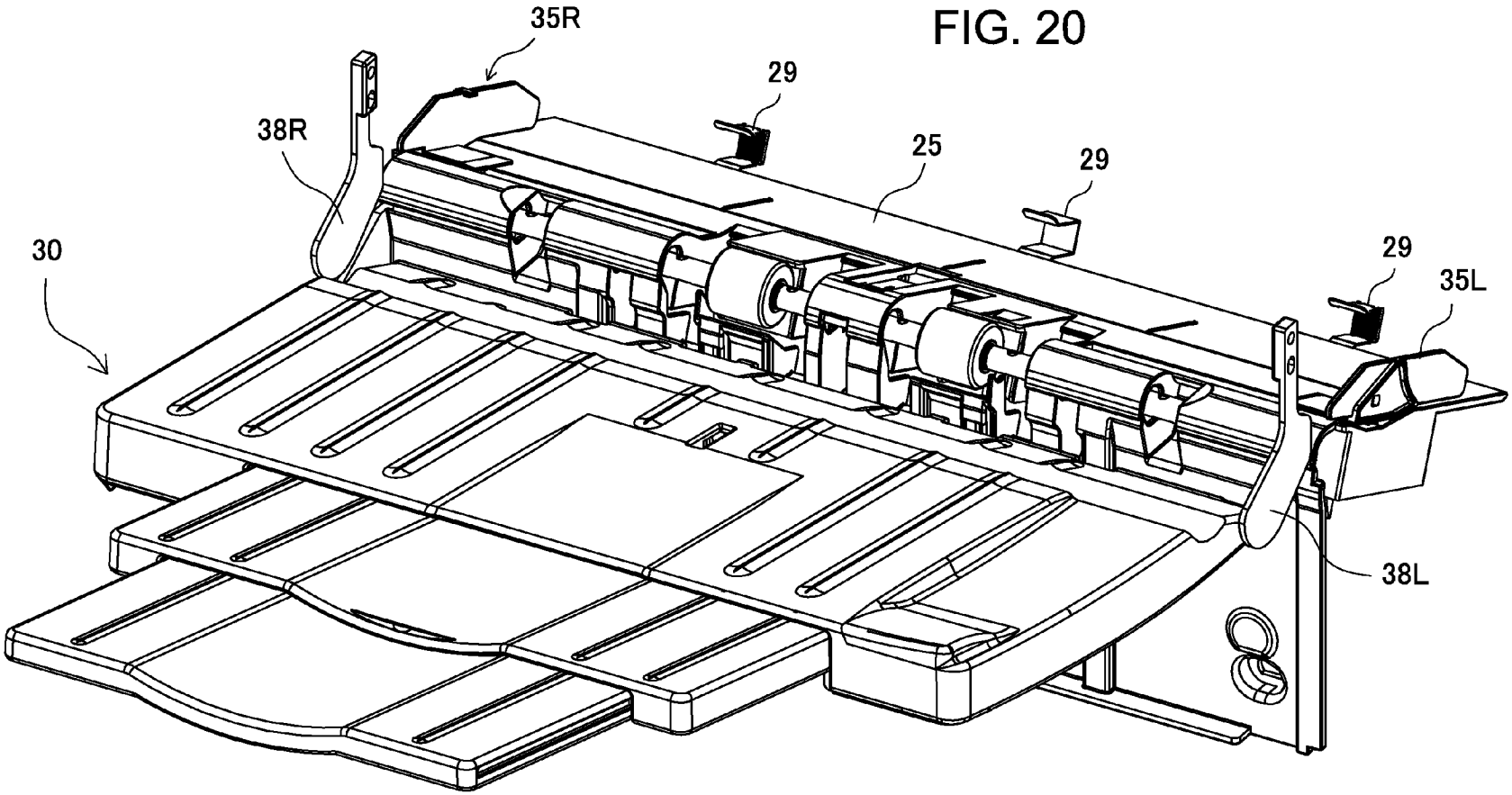
FIG. 20 is a perspective view illustrating a position relationship between the first and second alignment mechanisms.

As shown in FIG. 20, in the processing tray 25 is disposed an alignment mechanism 35 that is the first alignment device which moves back and forth in the direction orthogonal to the transport direction of the sheet transported from the sheet discharge outlet 24 to position. FIG. 3 shows the alignment mechanism 35 on a plan view, and the alignment mechanism 35 is provided with a left alignment plate 35L that engages in the left side edge of the sheet on the processing tray 25 and a right alignment plate 35R that engages in the right side edge of the sheet so as to position with reference to the center of the sheet carried in the processing tray 25 from the sheet discharge outlet 24.

The left and right alignment plates 35L and 35R are fitted and supported respectively on guide grooves (not shown) formed on the sheet support surface 25*a* of the processing tray 25, and are able to slide and shift in the direction (hereinafter, referred to as a sheet width direction) orthogonal to the transport direction of the sheet. Then, a pulley pair 55 is disposed along the guide groove in the bottom of the processing tray 25, and belts 56 are looped in respective pulley pairs 55. Then, the left and right alignment plates 35L and 35R are fixed to respective belts 56. Further, one pulley of each pulley pair 55 is coupled to a shift motor MZ1 or MZ2.

The left alignment plate 35L and right alignment plate 35R formed in a pair of left and right in such a configuration reciprocate in the sheet width direction by driving of respective shift motors MZ1 and MZ2. At this point, by driving to rotate the left and right shift motors MZ1 and MZ2 the same amount in opposite directions in synchronization with each other, it is possible to align the sheet carried onto the processing tray 25 in the center reference.

Figure 4:
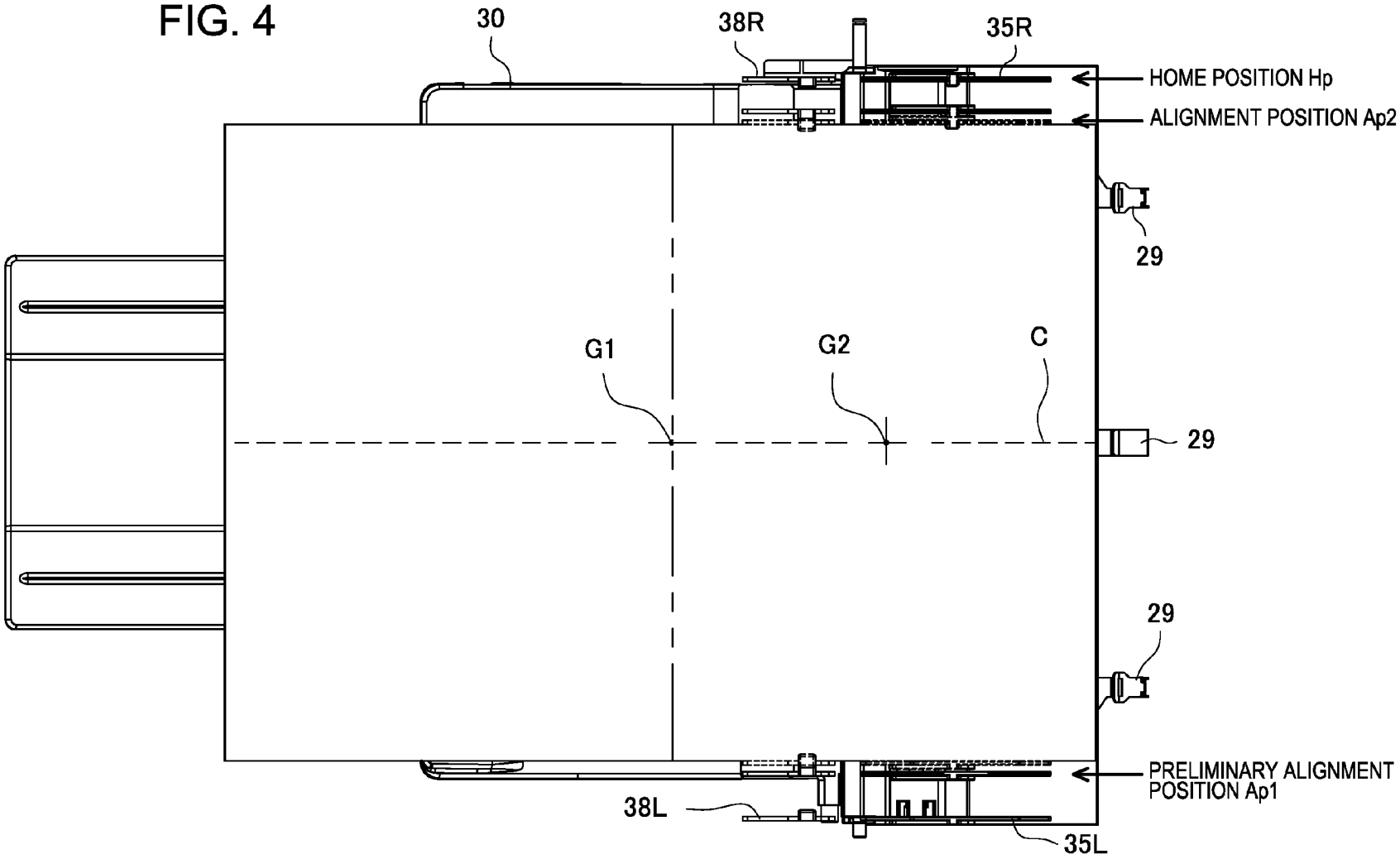
FIG. 4 is a plan view to explain alignment operation by first and a second alignment device.

In starting the apparatus, the alignment plates 35L and 35R are positioned in beforehand set home positions Hp as shown in FIG. 4, and a position sensor is disposed in this position. Then, when a CPU 160 (controller) described later in FIG. 13 receives size information of a sheet subjected to image formation from the image formation apparatus A, the CPU 160 controls the shift motors MZ1 and MZ2 based on the information, shifts the left and right alignment plates 35L and 35R to receiving positions that enable a predetermined sheet to be received, and makes a sheet receiving state. FIG. 4 shows an example of handling an A4 sheet transversely and an A3 sheet longitudinally with respect to the transport direction of the sheet, the home positions Hp are the receiving positions of the A3 or A4 sheet sent from the sheet discharge outlet 24 without change, and the alignment mechanism 35 is in the receiving state.

Then, when the alignment mechanism 35 performs alignment of the sheet with the alignment plates 35L and 35R, the CPU 160 controls driving of the shift motors MZ1 and MZ2 to shift, in two ways, to preliminary alignment positions Ap1 and alignment positions Ap2. The alignment positions A2 are approximately equal to a dimension (transverse dimension in an A4 sheet, longitudinal dimension in an A3 sheet) in the width direction of the sheet, and the preliminary alignment positions Ap1 are a dimension longer than this dimension.

Accordingly, in causing the alignment mechanism 35 to perform preliminary alignment operation, the CPU 160 shifts the alignment plates 35L and 35R to the preliminary alignment positions Ap1. When the alignment plates 35L and 35R are in the preliminary alignment positions Ap1, the sheet transported with the center line C in the transport direction being parallel to the transport direction does not come into contact with the alignment plates 35L and 35R. However, in the case of a skewed sheet with the center line C causing a deviation from the transport direction, the sheet comes into contact with the alignment plates 35L and 35R and is thereby aligned.

On the other hand, in causing the alignment mechanism 35 to perform alignment operation, the CPU 160 shifts the alignment plates 35L and 35R to the alignment positions Ap1. When the alignment plates 35L and 35R are in the alignment positions Ap2, the alignment plates 35L and 35R come into contact with the sheet to align the sheet uniformly in the width dimension.

[Sheet Transport Mechanism]

Returning to the explanation of FIGS. 1 and 2, in the processing tray 25 are disposed a reverse roller 32 that transports the sheet from the sheet discharge outlet 24 to the paper mount 25*a*, and a take-in roller 33 that is the sheet take-in device to feed the sheet on the paper mount 25*a* to the regulation stopper 29. The reverse roller 32 is comprised of a forward-backward rotation roller which transports the sheet transported from the sheet discharge outlet 24 in the sheet discharge direction, and then, feeds in the opposite direction by switchback.

Such a reverse roller 32 is comprised of an upper roller 32*a* and a lower roller 32*b* that come into contact and separate with/from each other, and in contrast to that the lower roller 32*b* is embedded and fixed into the paper mount 25*a*, the upper roller 32*a* is attached to the apparatus frame 21 to be able to move up and down by an up-and-down arm. Although not shown in FIG. 2, the up-and-down arm is coupled to an up-and-down motor 54 (see FIG. 13). Then, also not shown in FIG. 2, the upper roller 32*a* is coupled to a reverse roller drive motor 57 (see FIG. 13), and rotates in the sheet discharge direction or in the opposite direction (the sheet discharge opposite direction) corresponding to forward and backward rotation of the reverse roller drive motor 57.

Then, the CPU 50 described later positions the upper roller 32*a* in a separate upward position for a period during which a sheet front end detection signal from the sheet discharge sensor Se2 occurs and the sheet front end moves into a roller nip, and after the sheet front end moves into the roller nip, moves the upper roller 32*a* down to an actuation position for coming into press-contact with the lower roller 32*b*. Concurrently therewith, the CPU 50 rotates the upper roller 32*a* in the sheet discharge direction until the sheet rear end is transported from the sheet discharge outlet 24, and then, rotates in the sheet discharge opposite direction. By this means, the sheet transported from the sheet discharge path 22 travels in the sheet discharge direction toward the stack tray 30, and after the sheet rear end moves onto the processing tray 25 from the sheet discharge outlet 24, travels in the sheet discharge opposite direction toward the regulation stopper 29.

Accordingly, after detecting the sheet front end with the sheet discharge sensor Se2, the CPU 50 moves down the upper roller 32*a* waiting above to a downward nip position at timing at which the sheet front end moves into the roller nip, rotates a predetermined amount in the sheet discharge direction with the roller 32*a* in press-contact with the lower roller 32*b*, and then, rotates in the sheet discharge opposite direction. For this controlling, a delay circuit is constructed with reference to a signal that the sheet discharge sensor Se2 detects the sheet front end and a signal that the sensor detects the sheet rear end.

The take-in roller 33 is comprised of a belt member that rotates integrally with the sheet discharge roller 28 of the sheet discharge outlet 24, and is disposed to hang on the uppermost sheet on the paper mount 25*a* from the sheet discharge roller 28. Then, the roller 33 rotates in the same direction as in the sheet discharge roller 28, and provides the sheet on the paper mount with a transport force toward the regulation stopper 29. As other take-in rollers 33, without being limited to an endless belt, it is possible to adopt various kinds of mechanisms such as a roller structure that swings up and down and paddle structure.

Further, sheets (bunch) subjected to post-processing on the processing tray 25 are fed out to the stack tray 30 by operation of the reverse roller 32 due to rotation of the reverse roller drive motor 57 in the sheet discharge direction.

[Stack Tray]

The stack tray 30 is provided with a paper mount surface 30*a* inclined so that the downstream side in the sheet discharge direction is high and that the upstream side is low, and loads and stores sheets on the paper mount surface 30*a*. In this Embodiment, sheets that are transported from the sheet discharge outlet 24 to the processing tray 25 and that underwent post-processing are guided to the stack tray 30, and there is also the case where a sheet discharged from the sheet discharge outlet 24 is directly guided.

The stack tray 30 is fixed to a tray mount 30*c* supported by a guide rail 34 attached to the apparatus frame 21 in the vertical direction to be able to move up and down, and moves up and down by shifting the tray mount 30*c* up and down with a drive apparatus (not shown). At this point, for the height position of the stack tray 30, the drive apparatus is controlled based on a detection signal of a sensor not shown so that the position of the paper mount surface 30*a* or the sheet surface loaded and stored on the paper mount surface 30*a* is a position lower than the height position of the lower roller 32*b* by a predetermined height difference D.

[Second Alignment Device]

Figure 5:
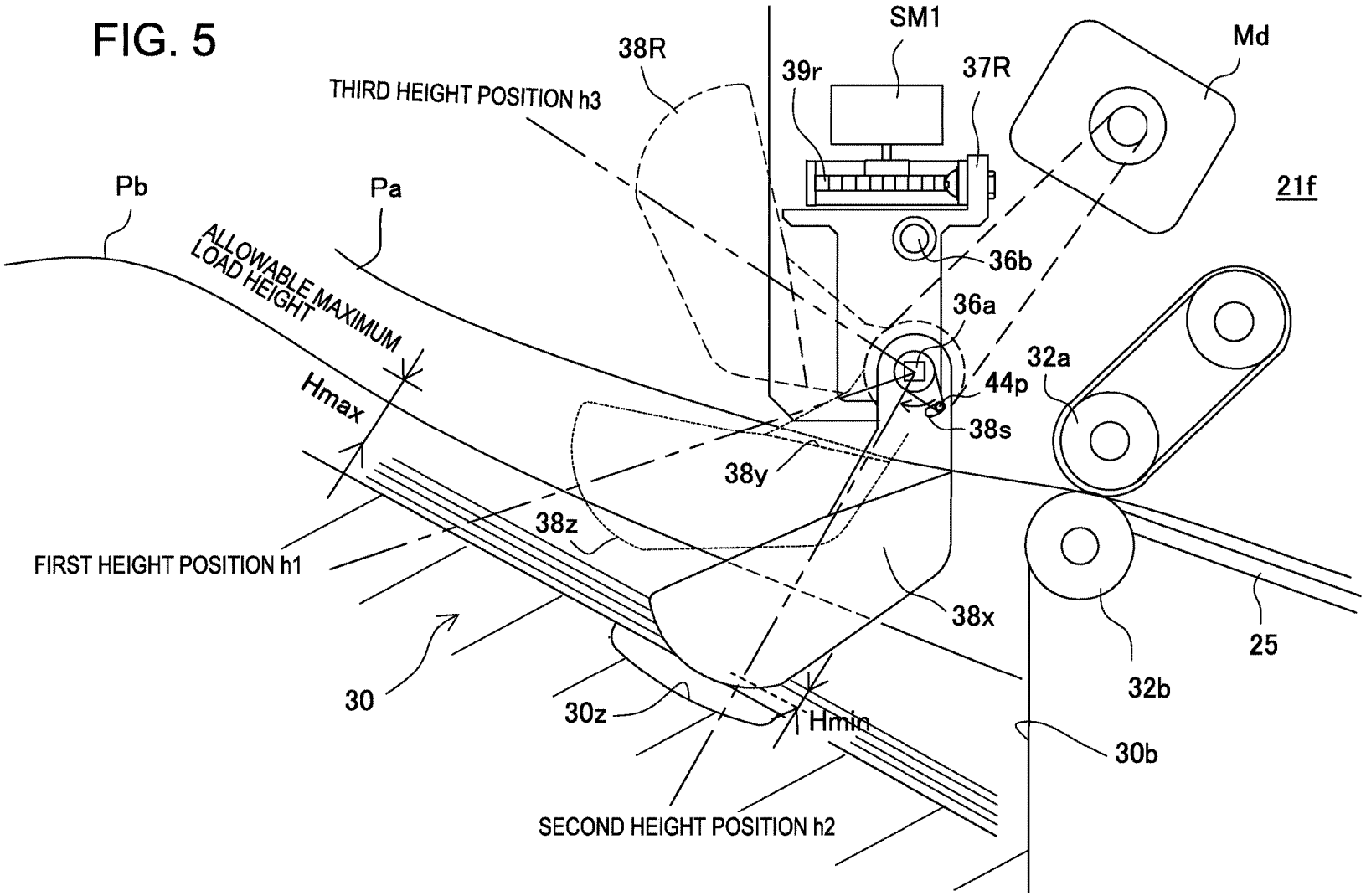
FIG. 5 is an explanatory view illustrating a relationship among the first to third heights of the second alignment device.
Figure 6A:
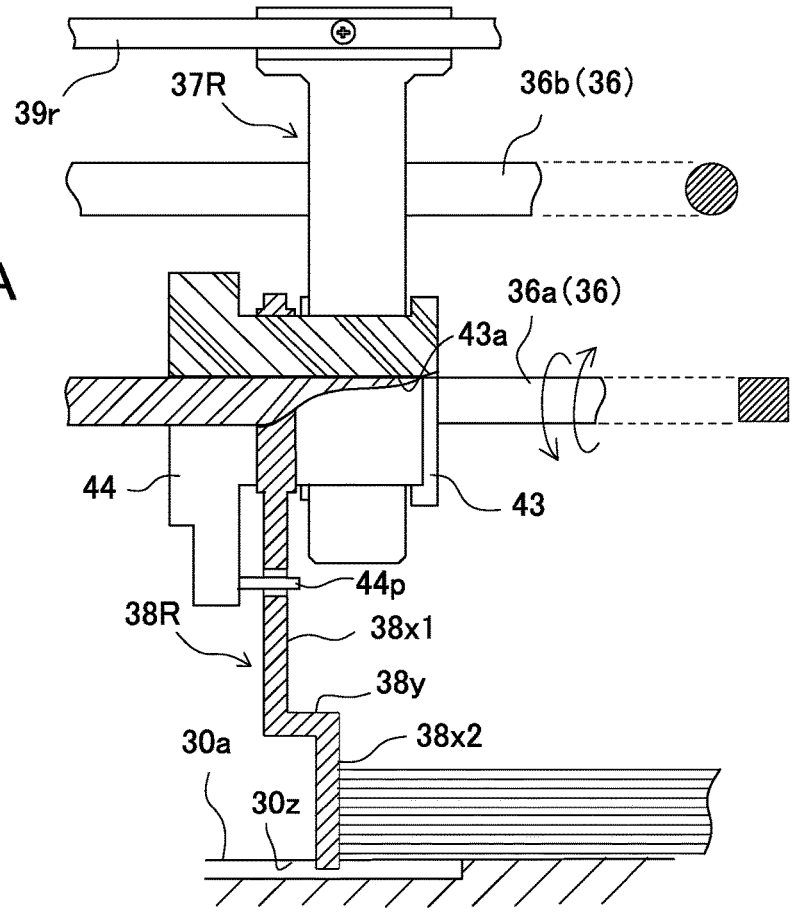
FIGS. 6A and 6B illustrate a configuration of the second alignment device, where

Above the stack tray 30 is provided an alignment mechanism 38 that is the second alignment device for aligning a sheet fed out of the reverse roller 32 in the width direction of the sheet. The alignment mechanism 38 has alignment members 38R and 38L capable of shifting in the width direction of the sheet guided to the processing tray 25, and in this respect, is the same as the alignment mechanism 35. As well as the operation, the alignment members 38R and 38L of the alignment mechanism 38 perform a guide of sheets (bunch) subjected to post-processing on the processing tray 25 to the stack tray 30, and holding and width-alignment of sheets collected on the stack tray 30. Therefore, as shown in FIGS. 5 and 6A, each of the alignment members 38R and 38L is obtained by performing bending processing on a wing-shaped plate, and has a structure having a side regulation surface 38*x* and sheet support surface 38*y*. Then, the side regulation surface 38*x* is divided into two-way side regulation surfaces 38*x*1 and 38*x*2 (see FIG. 6A) that are higher and lower with the sheet support surface 38*y* as the boundary. The first side regulation surface 38*x*1 regulates the width of sheets on the processing tray 25, and the second side regulation surface 38*x*2 regulates the width of sheets on the stack tray 30. Since the alignment members 38R and 38L are bilaterally symmetric and have the same structure, FIGS. 5 and 6A respectively show a side elevational view and a front cross-sectional view viewed from the transport direction of only the alignment member 38R.

[Width-Direction Shift Device]

Figure 7:
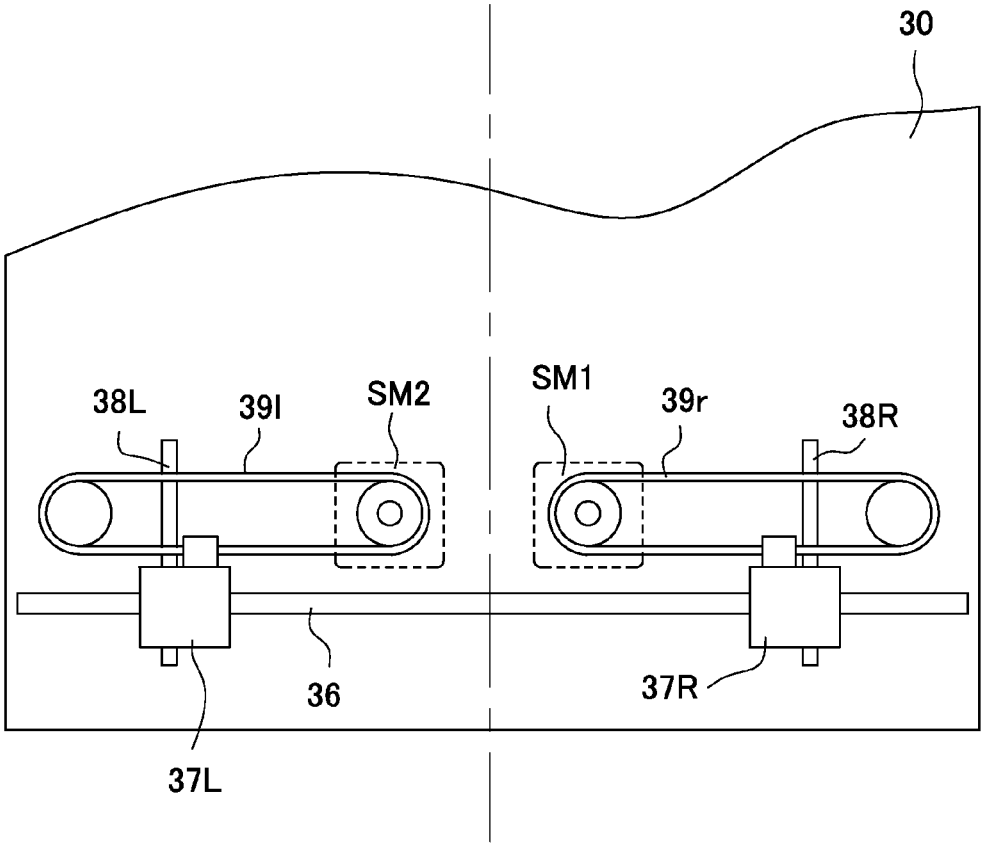
FIG. 7 is an explanatory view of a width-direction shift device of the second alignment device.

Described is a width-direction shift device for shifting the alignment members 38R and 38L of the alignment mechanism 38 in the sheet width direction. In FIGS. 6A and 7, a guide rail 36 is comprised of a first guide rod 36*a* and second guide rod 36*b*, and is laid and supported by left and right side plates of the apparatus frame 21 in the sheet width direction. A left bracket 37L and right bracket 37R (see FIG. 7) are fitted into the rods 36*a* and 36*b* to be able to respectively slide and shift in the sheet width direction, and the alignment members 38R and 38L are respectively attached to the right and left brackets 37R and 37L. Then, the first guide rod 36*a* is comprised of a non-circular shaft of cross section in the shape of a rectangle, the shape of a convexity or the like, and is axially supported by the apparatus frame 21 to be rotatable. Further, the second guide rod 36*b* is comprised of a shaft of circular cross section, and is supported by the apparatus frame 21 in a fixed manner.

Then, the right bracket 37R is coupled to a right drive belt 39*r*, and similarly, the left bracket 37L is coupled to a left drive belt 391. Each of the right and left drive belts 39*r* and 391 is wound around pulleys axially supported by the apparatus frame 21, and one of the pulleys is coupled to a shift motor (stepping motor) SM1 or SM2. Accordingly, the right and left brackets 37R and 37L are able to shift to arbitrary positions in the sheet width direction by forward and backward rotation of the right and left shift motors SM1 and SM2.

Thus, the shift motors SM1 and SM2 and transmission mechanisms (drive belts and pulleys) are coupled to a pair of right and left brackets 37R and 37L, and the width-direction shift device is configured to shift in the directions to mutually approach and separate. The width-direction shift device is not limited to the structure as shown in FIG. 7, and it is also possible to constitute using an interlock mechanism such as rack-pinion that shift in mutually opposite directions by the same amount.

By the width-direction shift device of such a configuration, the alignment members 38R and 38L shift among the home positions Hp, preliminary alignment positions Ap1 and alignment positions Ap1 as described in FIG. 4. Accordingly, the alignment members 38R and 38L are positioned in the home positions Hp while being in a receiving state in starting the apparatus as in the alignment plates 35L and 35R, and by driving of the shift motors SM1 and SM2 controlled by the CPU 160 (see FIG. 13), shift among the home positions Hp that are receiving positions, preliminary alignment positions Ap1 and alignment positions Ap2. Then, when the alignment members 38R and 38L shift to the preliminary alignment positions Ap1 and alignment positions Ap2, the members regulate a sheet guided to the processing tray 25 with respective side regulation surfaces 38*x*1. In addition, as described previously, in this Embodiment, the home positions Hp in which the alignment members 38R and 38L are positioned in starting the apparatus are made the receiving positions without change, and the receiving positions may be set at different positions. In this case, a distance between the alignment members 38R and 38L in the receiving positions is set to be narrower than the distance between the home positions Hp, while being wider than the distance between the preliminary alignment positions Ap1.

[Height-Direction Shift Device]

The alignment members 38R and 38L are able to shift in the sheet width direction, and are further able to move up and down to different height positions of a "first height position h1", "second height position h2" and "third height position h3" as shown in FIG. 5. The height-direction shift device will be described.

As described previously, the first guide rod 36*a* is comprised of the shaft of non-circular cross section, and is axially supported by the apparatus frame 21 to be rotatable, and a collar member 43 is fitted into the first guide rod 36*a*. An inside diameter hole 43*a* of the collar member 43 is fitted into the guide rod 36*a* to be able to slide (loose-fit) in the shaft direction (lateral direction in FIG. 6A), and rotate integrally in the circumferential direction.

Figure 6B:
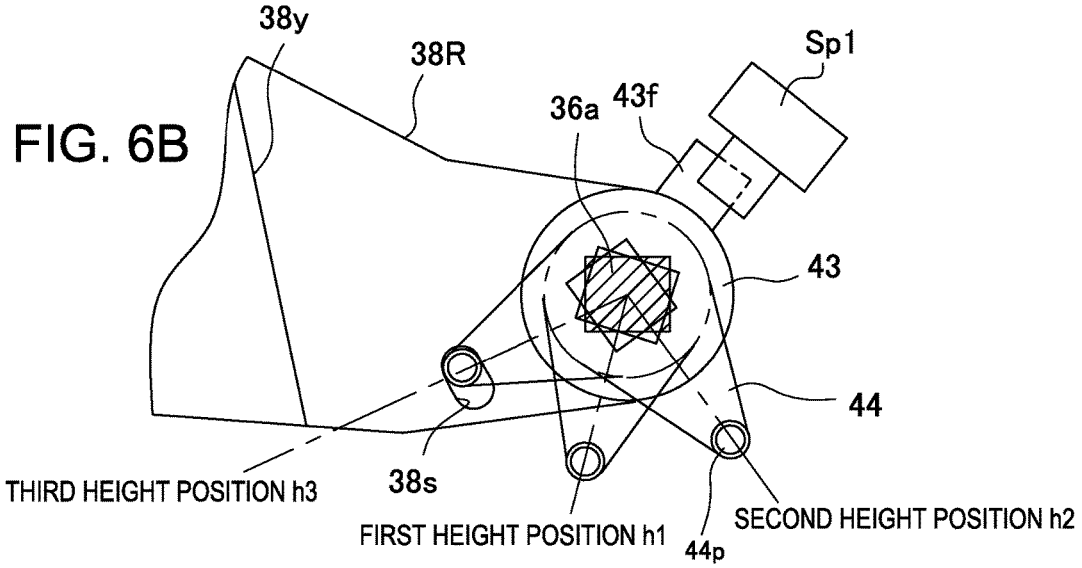

Accordingly, when the first guide rod 36*a* is rotated forward and backward with an angle-control motor Md (see FIG. 5), the collar member 43 also rotates integrally in the same direction, and slides freely in the rod shaft direction (sheet width direction) without constraint. Then, as shown in FIGS. 6A and 6B, a swing arm 44 is integrally formed in the collar member 43, and further, the alignment member 38R (38L) is coupled to the swing arm 44 with a couple pin 44P.

Accordingly, when the guide rod 36*a* is rotated by rotation of the angle-control motor Md, the rotation force is transferred to the swing arm 44 integral with the collar member 43 via the member 43, and the alignment members 38R and 38L are rotated. At this point, in the collar member 43 are disposed a position sensor Sp1 and flag 43*f* (see FIG. 6B) for angle detection, the position sensor Sp1 detects the flag 43*f*, and by controlling the rotation angle of the angle-control motor Md with reference to the detection signal, the alignment members 38R and 38L respectively shift to the first height position h1, second height position h2 and third height position h3. To adjust the height positions of the alignment members 38R and 38L, as well as detection of the flag 43*f* with the position sensor Sp1, there are a method of directly detecting angle positions of the alignment members 38R and 38L, a meted of detecting the number of revolutions of the angle-control motor Md and the like.

When the alignment members 38R and 38L are in the first height position h1, the lowest ends of the alignment members 38R and 38L are set in a position [Hmax>maximum load height] (see FIG. 5) higher than the maximum load height on the stack tray 30. This is to prevent alignment operation of the alignment members 38R and 38L that align a sheet carried in the processing tray 25 from the sheet discharge outlet 24 from being inhibited by sheets loaded on the stack tray 30 positioned below not to shift. By this means, the alignment members 38R and 38L are capable of positioning the sheet on the processing tray 25 in an accurate regulation position irrespective of the size posture of sheets loaded on the stack tray 30. Particularly, it is possible to position sheets to align for post-processing on the processing tray 25 in the sheet width direction while offsetting a predetermined amount, relative to a load reference of sheets loaded on the stack tray 30, and it is possible to arrange the post-processing device 31 such as a stapler apparatus in a dent position inside the apparatus housing. This device that the need is eliminated for providing a unit shift mechanism for moving the post-processing device from inside the apparatus to a processing position on the processing tray 25 to perform post-processing as in the conventional manner.

Figure 8A:
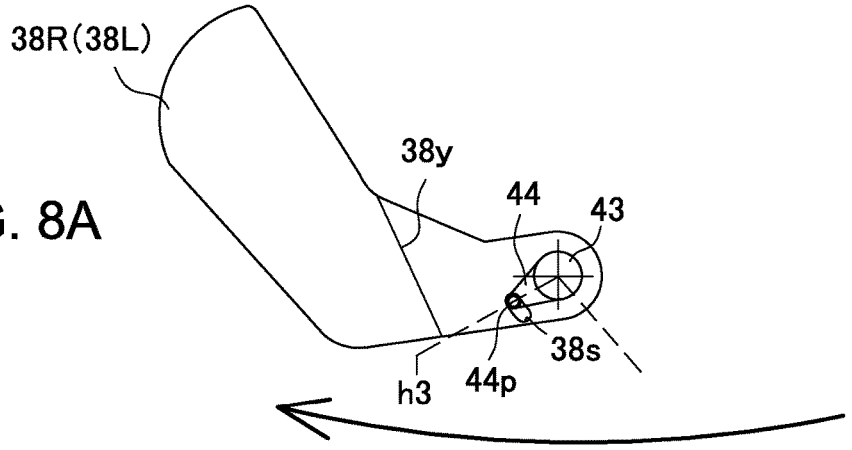
FIGS. 8A, 8B and 8C contain explanatory views illustrating operation in each of the first to third height positions of the second alignment device.
Figure 8B:
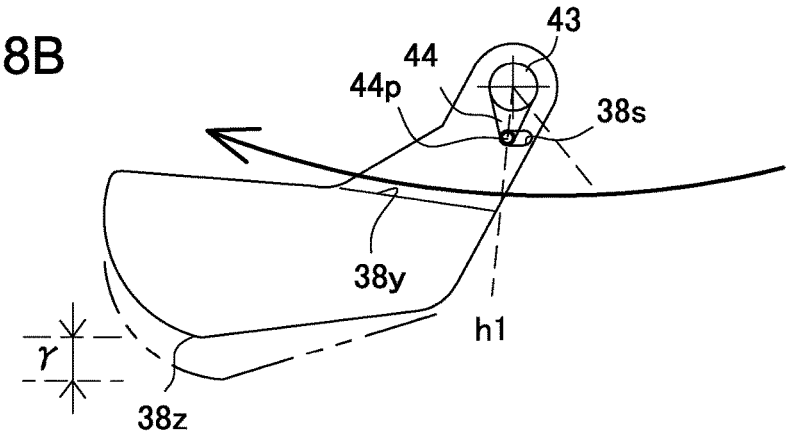

Then, in the first height position h1, since the sheet support surfaces 38*y* of the alignment members 38R and 38L are set in a height position substantially forming the same plane as the height position of the processing tray 25, at this point, as shown in FIG. 8B, the alignment members 38R and 38L guide a sheet shifting in the arrow direction from the sheet discharge outlet 24 to the processing tray 25 by supporting the lower surface thereof. In this guide operation, the right and left alignment members 38R and 38L are in the home positions Hp (sheet receiving positions) wider than the sheet width.

Further, in the height position h1, the alignment members 38R and 38L press the uppermost paper on the stack tray 30 with paper press surfaces 38*z* under its own weight. The pressing action due to its own weight is attained by a slit (cam groove) 38*s* formed between the alignment mechanism 38 and the couple pin 44*p*. In other words, as shown in FIG. 8B, since the couple pin 44*p* is fitted into the slit 38*s* (cam mechanism) formed in the alignment mechanism 38, the alignment members 38R and 38L engage in the uppermost sheet on the stack tray 30 under its own weight. Accordingly, the alignment members 38R and 38L are configured to be able to move up and down corresponding to a load amount of the uppermost sheet on the stack tray 30, and are able to move up and down in the range shown by y shown in the figure.

Figure 9:
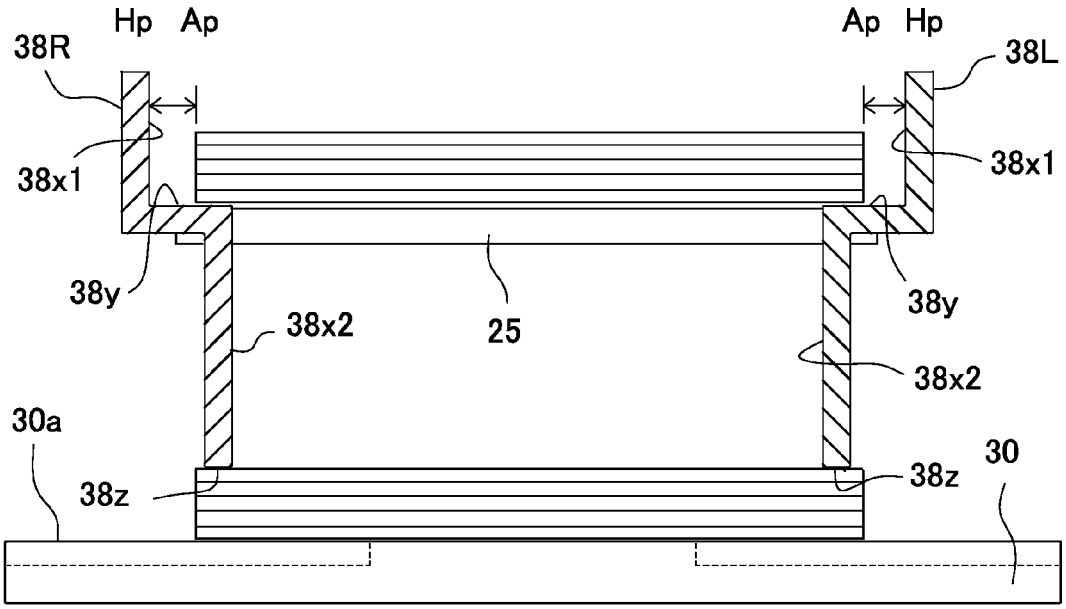
FIG. 9 is an explanatory view illustrating an operation state of the second alignment device in carrying a sheet onto a processing tray.

FIG. 9 shows a state, from the front, in which the alignment members 38R and 38L are in the first height position h1 and a sheet is carried onto the processing tray 25. The sheets transported from the sheet discharge outlet 24 are placed and supported on the processing tray 25 and the sheet support surfaces 38*y*. In addition, in FIGS. 9 and 10, for convenience in description, the preliminary alignment position Ap1 and alignment position Ap1 are not distinguished and described as alignment positions Ap.

Figure 10:
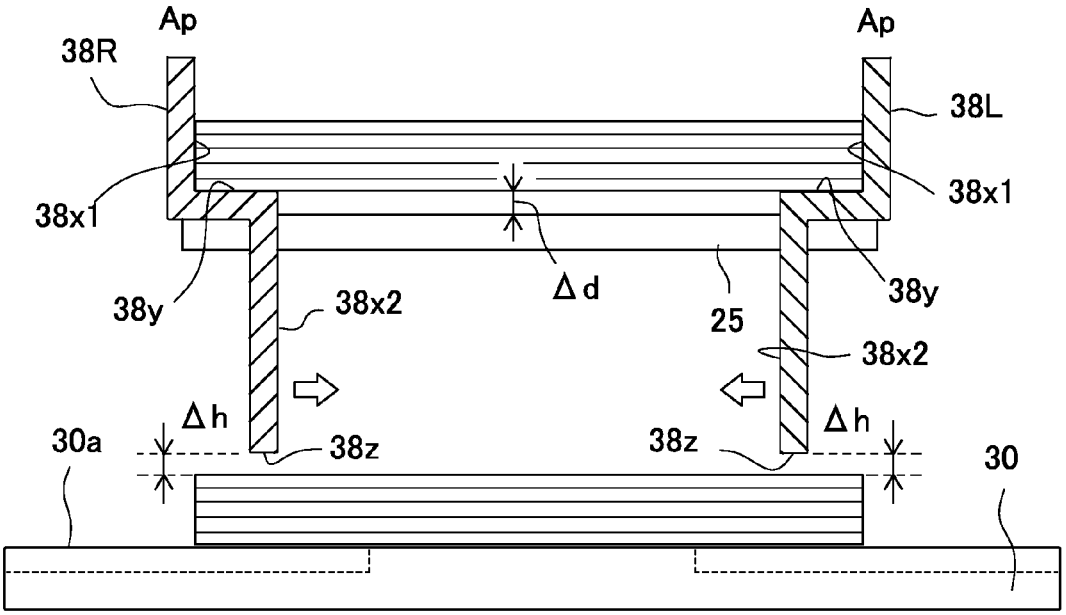
FIG. 10 is an explanatory view illustrating an operation state of the second alignment device in carrying onto the processing tray.

Then, when a sheet is carried onto the processing tray 25 on a sheet-by-sheet basis, for each time, as shown in FIG. 10, the alignment members 38R and 38L shift from the home positions Hp to the alignment positions Ap to align. In FIG. 10, the reason why the alignment members 38R and 38L are moved up by a predetermined amount Δd is to prevent loaded sheets on the stack tray 30 from causing misregistration in shifting the alignment members 38R and 38L from the home positions Hp to the alignment positions Ap. In other words, the alignment members 38R and 38L are set in positions to press the sheets loaded on the stack tray 30 with the paper press surfaces 38*z*, and therefore, when the alignment members 38R and 38L shift to the alignment positions Ap, the loaded sheets on the stack tray 30 also shift by the friction forces. In order to prevent such an event, the alignment members 38R and 38L are moved up by the predetermined amount ΔD to form clearances Δh between the sheet press surfaces 38*z* and the sheet surface, and the loaded sheets are thereby prohibited from shifting.

Figure 8C:
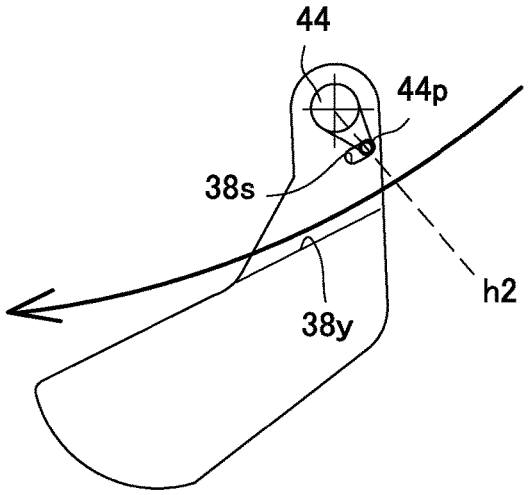

FIG. 8C shows a state in which the alignment members 38R and 38L are in the second height position h2, and lower end positions of the alignment members 38R and 38L are set at positions lower than the paper mount surface 30*a*. A concave dent portion 30*z* is formed in the paper mount surface 30*a*, and the alignment members 38R and 38L are positioned in positions substantially lower than the paper mount surface 30*a*.

Figure 11:
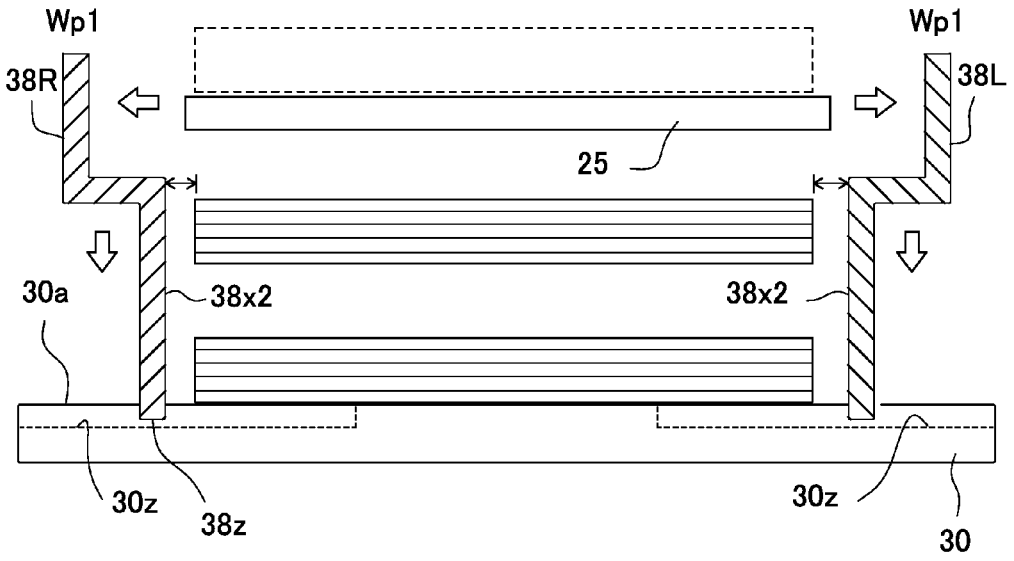
FIG. 11 is an explanatory view illustrating an operation state of the second alignment device in discharging a sheet bunch to a stack tray.

FIG. 11 shows a state, from the front, in which sheets are shifted from the processing tray 25 to the stack tray 30 when the alignment members 38R and 38L are in the second height position h2. In this state, the alignment members 38R and 38L are positioned in stack positions Wp1 different from the home positions Hp or the alignment positions Ap. Then, the processed sheets (bunch) are supported by only the processing tray 25 and shift above the sheet support surfaces 38*y* of the alignment members 38R and 38L.

Figure 12:
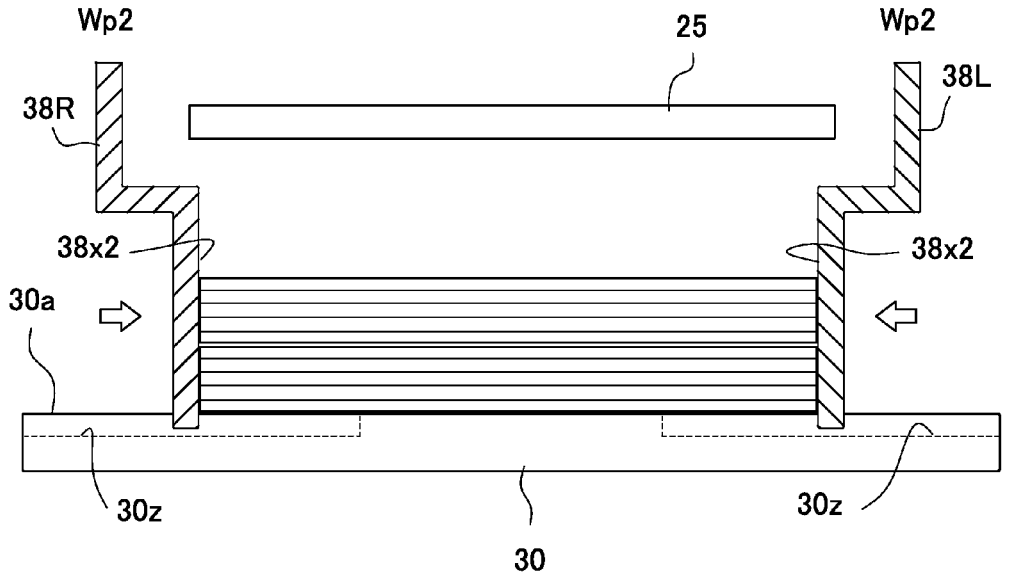
FIG. 12 is an explanatory view illustrating an operation state of the second alignment device in completing loading of the sheet bunch into the stack tray.

Then, as shown in FIG. 12, when the alignment members 38R and 38L in the second height position h2 are shifted from the stack positions Wp1 to stacked sheet alignment positions Wp2, the sheets on the stack tray 30 are aligned so that the position in the sheet width direction is matched with the reference position, and after this operation, the alignment mechanism 38 is returned to the sheet receiving positions in the home positions Hp in FIG. 9.

Then, when the alignment members 38R and 38L are in the third height position h3, as shown in FIG. 8A, the alignment members 38R and 38L are in positions retracted to outside both a shift trajectory (sheet carry-in path) Pa of a sheet shifting from the sheet discharge outlet 24 to the processing tray 25 and a shift trajectory (sheet transport path) Pb of a sheet shifting from the sheet discharge outlet 24 to the stack tray 30, and do not come into contact with any of the sheet to carry onto the processing tray 25 and the sheet to carry in the stack tray 30. Accordingly, when a sheet jam or the like occurs, by shifting the alignment members 38R and 38L to the third height position h3 and halting the apparatus, the alignment mechanism 38 is not obstruction in removing the sheet jammed in the sheet discharge path.

[Control Configuration]

Figure 13:
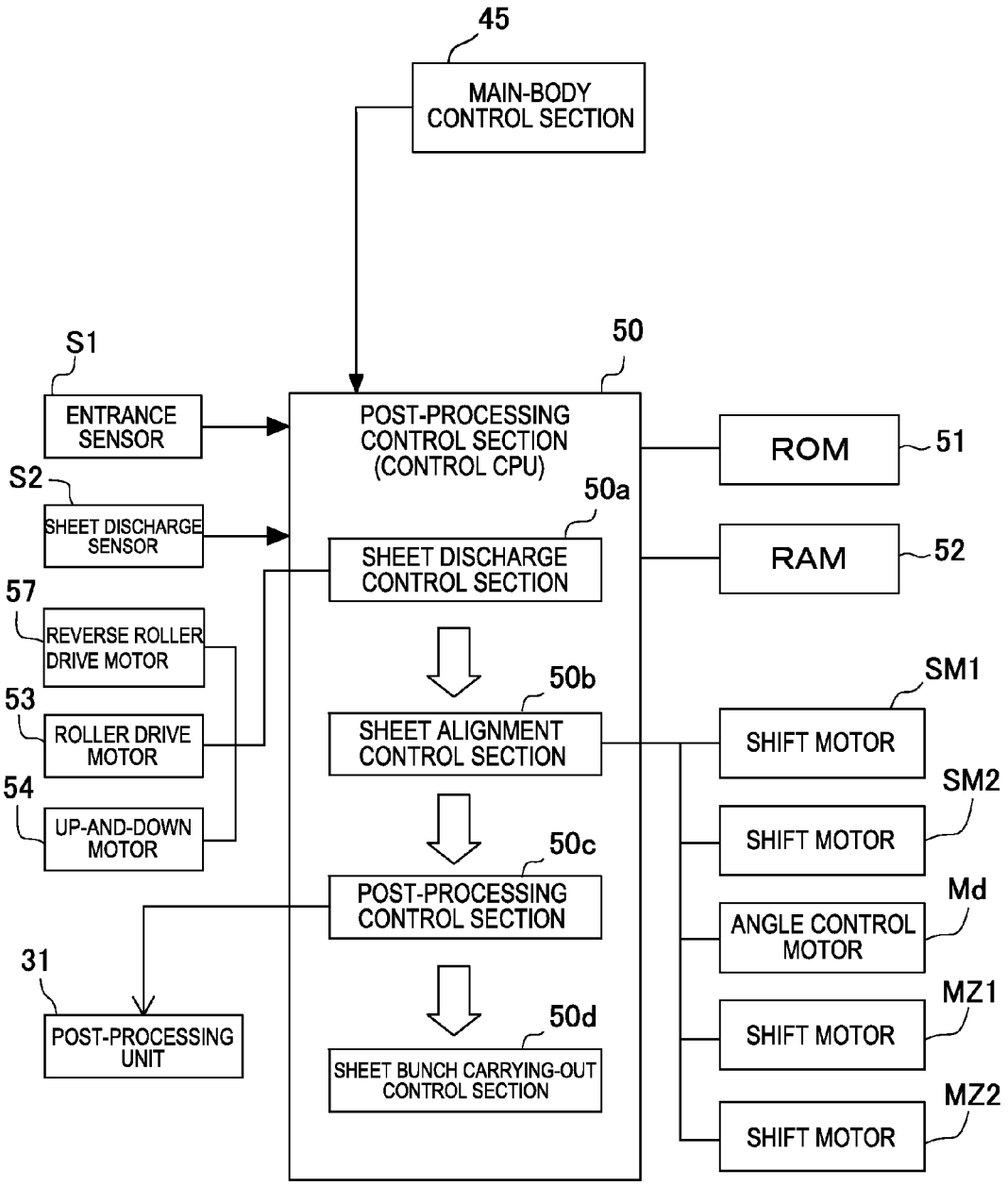
FIG. 13 is a block diagram illustrating a controller configuration.

A control configuration of the post-processing apparatus B according to the present invention will be described next according to a block diagram of FIG. 13. The CPU 50 is a controller for executing programs stored in ROM 51, collating image-formed sheets to perform post-processing (staple binding), carrying out the binding-processed sheets (bunch) to the stack tray 30, and thus controlling the entire operation of the post-processing apparatus B. At this point, upon receiving sheet size (also including a length in the direction orthogonal to the transport direction) information, sheet property (paper thickness, material, the degree of curl) information, paper feed path information, transport path information and job end signal from a main-body control section 45 of the image formation apparatus A, the CPU 50 controls post-processing operation based on control data stored in RAM 52.

Accordingly, the CPU 50 executes the programs stored in ROM 51, and thereby functions as a sheet discharge control section 50*a* that receives a sheet transported from the upstream image formation apparatus A in the sheet discharge path 22, a sheet alignment control section 50*b*, a post-processing control section 50*c*, and a sheet bunch carrying-out control section 50*d*. Control operations performed by the CPU 50 will be described below for each of the control sections 50*a* to 50*d*.

The sheet discharge control section 50*a* controls the roller drive motor 53 so as to transport a sheet carried in the sheet discharge path 22 toward the sheet discharge outlet 24 with the sheet discharge roller 28. Concurrently therewith, the sheet discharge control section 50*a* causes the upper roller 32*a* to wait in a waiting position when the sheet is transported from the sheet discharge outlet 24, brings the upper roller 32*a* into press-contact with the lower roller 32*b* after the sheet front end passes, and after rotating the reverse roller 32 in the sheet discharge direction, at timing at which the sheet rear end passes through the sheet discharge sensor Se2, reverses the transport direction of the reverse roller 32. This operation is attained by controlling the up-and-down motor 54 of the reverse roller 32 and forward and backward rotation of the reverse roller drive motor 57. In this case, corresponding to a command from the main-body control section 45, the sheet discharge control section 50*a* is capable of switching rotation of the roller drive motor 53 and reverse roller drive motor 57 to high speed to make a high-speed transport mode so as to make the transport speed toward the sheet discharge outlet 24 by the sheet discharge roller 28 and the transport speed by the reverse roller 32 high speed.

The sheet alignment control section 50*b* controls driving of the shift motors SM1 and SM2, and thereby controls shift positions of the right and left alignment members 38R and 38L in the sheet width direction. Further, the sheet alignment control section 50*b* controls driving of the shift motors MZ1 and MZ2, and thereby controls shift positions of the left alignment plate 35L and right alignment plate 35R of the alignment mechanism 35 in the sheet width direction.

Moreover, corresponding to a command from the main-body control section 45, the sheet alignment control section 50*b* controls up-and-down operation and rotation operation of the reverse roller 32, while controlling operation of the shift motors SM1 and SM2 and the angle-control motor Md so as to directly guide a sheet from the sheet discharge path 22 to the stack tray 30, or guide sheets which are transported to the processing tray 25 and subjected to post-processing to the stack tray 30.

The post-processing control section 50*c* controls the post-processing device 31 such as staple binding, punching and stamping. In this case, when recognizing that the last sheet is carried in the processing tray 25 from the job end signal from the main-body control section 45, after aligning the sheet in the width direction, the post-processing control section 50*c* transmits a start signal to a drive motor of the post-processing device 31. Upon receiving the signal, the post-processing device 31 executes binding operation, and after finishing the operation, transmits an end signal to the CPU 50.

Upon receiving the end signal from the post-processing device 31, the sheet bunch carrying-out control section 50*d* brings the reverse roller 32 into press-contact with the sheet bunch on the processing tray 25, and drives the reverse roller drive motor 57 in the direction of the stack tray 30. By this operation, the sheet bunch on the processing tray 25 is stored in the stack tray 30 on the downstream side.

[Control of Alignment Operation]

In the post-processing apparatus B with the above-mentioned configuration, the present invention is to control alignment operation by the alignment mechanisms 35 and 38 so that the center line C (see FIG. 4) of the sheet sent from the sheet discharge outlet 24 is parallel to the transport direction. Control of the alignment mechanisms 35 and 38 by the CPU 50 will be described below based on a flowchart.

Figure 14:
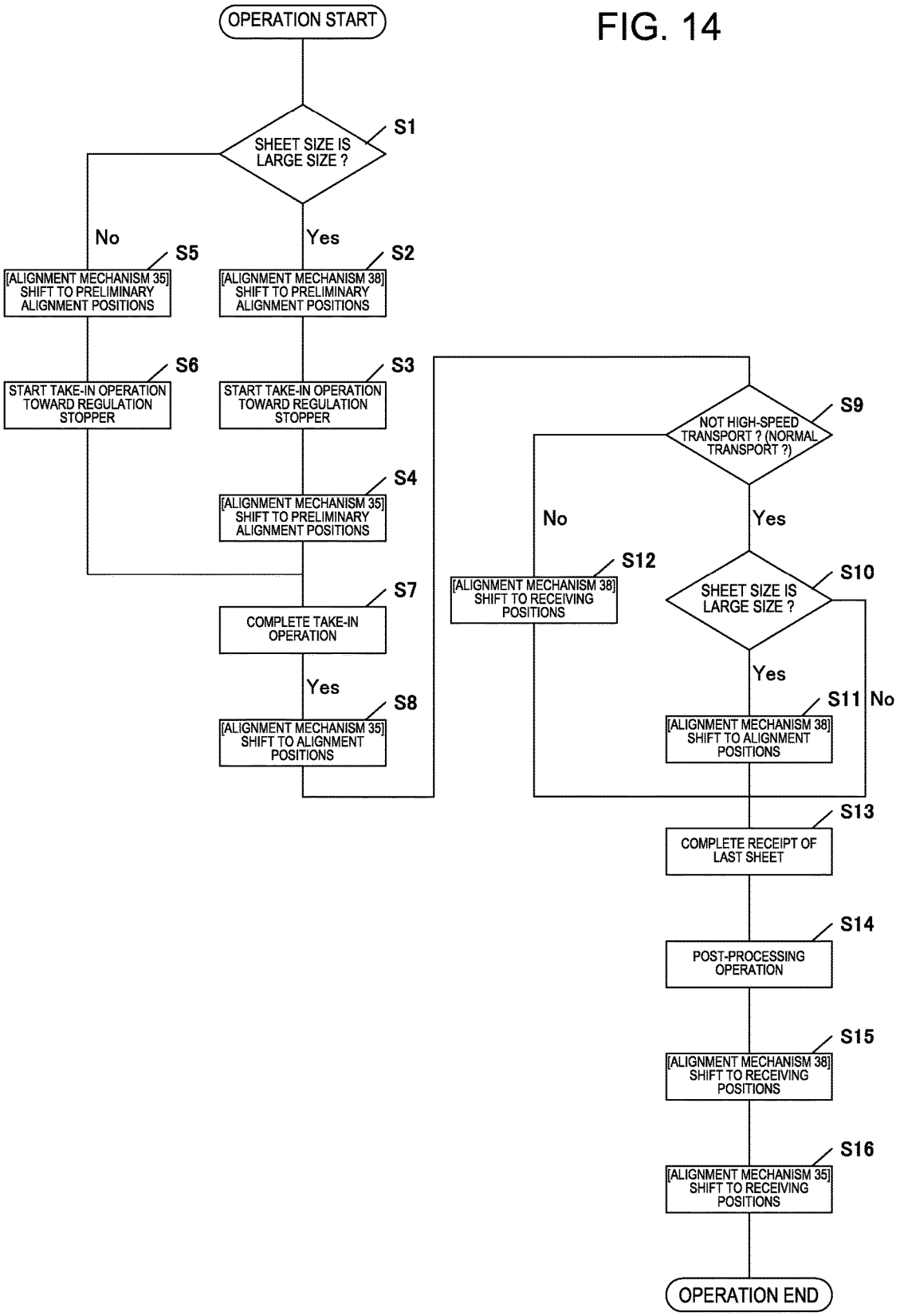
FIG. 14 is a flowchart to explain control operation by the controller for first and second alignment mechanisms to perform alignment operation.
Figure 19:
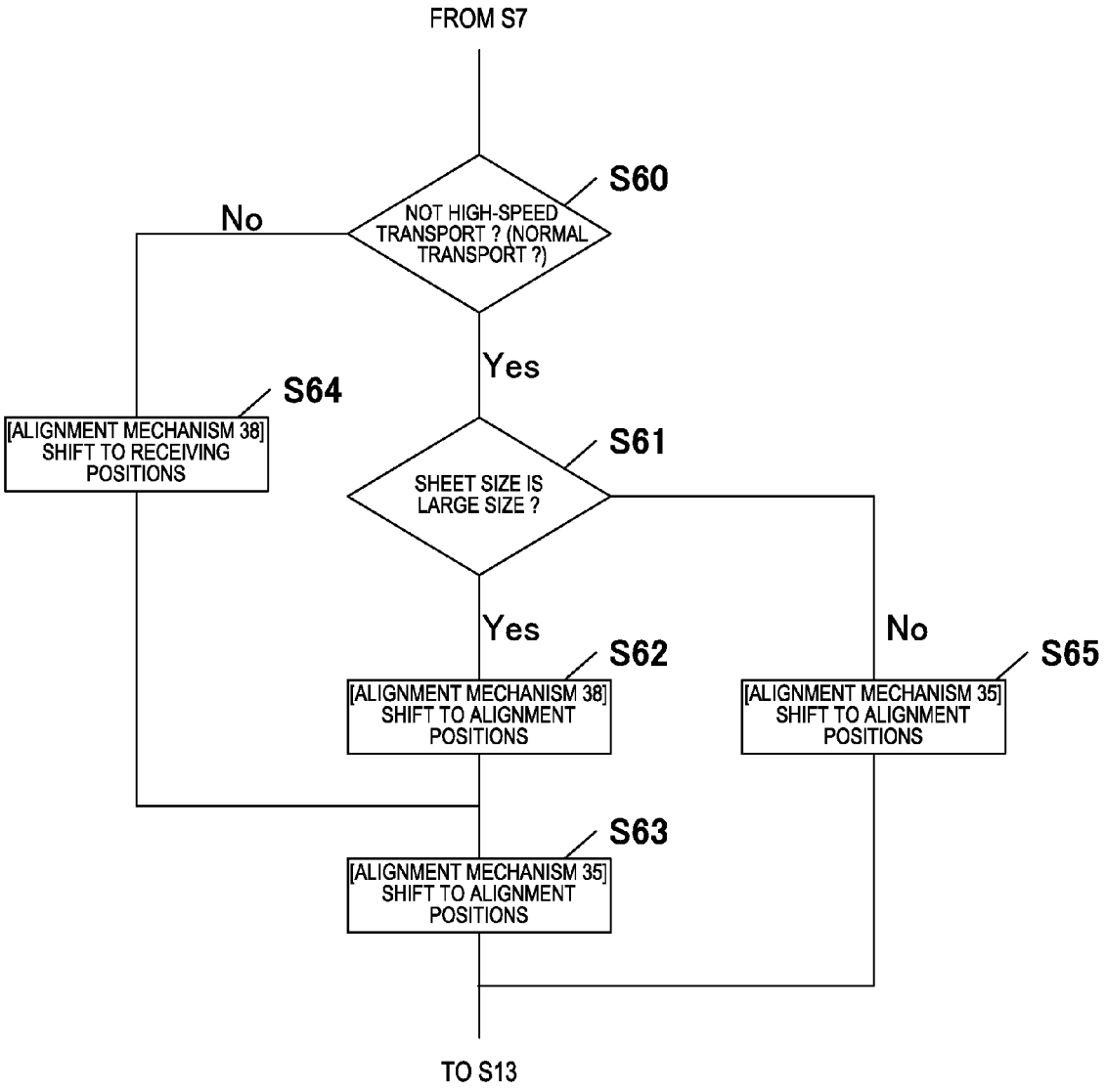
FIG. 19 is a flowchart illustrating Modification 5 of the flowchart of FIG. 14.

In a flowchart in FIG. 14, in step S1, the sheet alignment control section 50*b* determines whether the size of the sheet is a large size (A3 longitudinal) corresponding to a signal transmitted from the main-body control section 45. Then, in the case of the large size, as shown in FIG. 19, since the center of gravity G1 of the sheet is close to the alignment members 38R and 38L, in step S2 the section 50*b* controls driving of the shift motors SM1 and SM2 so that the alignment members 38R and 38L are in the preliminary alignment positions Ap1 (step S2).

Then, the sheet discharge control section 50*a* controls the up-and-down motor 54 of the reverse roller 32, forward and backward rotation of the reverse roller drive motor 57, and the roller drive motor 53, and drives the reverse roller 32 and take-in roller 33 so as to take in the sheet toward the regulation stopper 29 (step S3). Subsequently, the sheet alignment control section 50*b* controls driving of the shift motors MZ1 and MZ2 so that the alignment plates 35R and 35L are in the preliminary alignment positions Ap1 (step S4), and then, performs processing of step S7.

On the other hand, when the sheet alignment control section 50*b* determines that the size of the sheet is not the large size (A4 transverse) in step S1, the section 50*b* proceeds to step S5, and controls driving of the shift motors MZ1 and MZ2 so that the alignment plates 35R and 35L are in the preliminary alignment positions Ap1. Then, the sheet discharge control section 50*a* controls the up-and-down motor 54 of the reverse roller 32, forward and backward rotation of the reverse roller drive motor 57, and the roller drive motor 53, and drives the reverse roller 32 and take-in roller 33 so as to take in the sheet toward the regulation stopper 29 (step S6), and the processing of step S7 is performed. Accordingly, when the size of the sheet is not the large size, since the center of gravity of the sheet is on the processing tray 25 side, controlling the alignment members 38R and 38L to the preliminary alignment positions Ap1 is not performed.

In step S7, when the sheet alignment control section 50*b* detects a lapse of predetermined time required for the sheet to arrive at the regulation stopper 29 since the detection signal from the sensor or take-in start, the section 50*b* controls driving of the shift motors MZ1 and MZ2 so that the alignment plates 35R and 35L are from the preliminary alignment positions Ap1 to the alignment positions Ap1 (step S8).

In next step S9, the sheet alignment control section 50*b* determines whether the high-speed transport mode is indicated from the main-body control section 45. When the mode is not the high-speed transport mode, in step S10, the section 50*b* checks whether the size of the sheet is the large size. In the case of the large size, in step S11, the section 50*b* controls driving of the shift motors SM1 and SM2 so that the alignment members 38R and 38L are from the preliminary alignment positions Ap1 to the alignment positions Ap1. In this case, when the size of the sheet is not the large size, the section 50*b* directly proceeds to next step S13.

On the other hand, when the sheet alignment control section 50*b* determines that the mode is the high-speed transport mode in step S9, the section 50*b* controls driving of the shift motors SM1 and SM2 so that the alignment members 38R and 38L are from the preliminary alignment positions Ap1 to the sheet receiving positions Hp, and performs processing of step S13. In addition, in the processing of step S12, when the sheet is not the large size, since the flow does not pass through step S4 in the processing steps up to step S12 and the processing of step S4 is not executed, the alignment members 38R and 38L are maintained in the sheet receiving positions Hp from the beginning.

In step S13, the sheet alignment control section 50*b* determines whether the sheet sent from the sheet discharge outlet 24 is the last sheet with a signal from the main-body control section 45. When the sheet is not the last sheet, the processing of from step 1 is repeated.

When it is determined that the sheet is the last sheet in step S13, the flow proceeds to processing of step S14, and the post-processing control section 50*c* controls binding operation of the post-processing device 31. Then, the sheet alignment control section 50*b* controls driving of the shift motors SM1 and SM2 so that the alignment members 38R and 38L return to the sheet receiving positions Hp (step S15). In the processing of step S15, in the case where the mode is a normal transport mode and the sheet is the large size, the alignment members 38R and 38L shift from the alignment positions Ap2 to the sheet receiving positions Hp. In the other case, the alignment members 38R and 38L are maintained in the sheet receiving positions Hp from the beginning. Subsequently, the sheet alignment control section 50*b* controls driving of the shift motors MZ1 and MZ2 so that the alignment plates 35R and 35L return to the sheet receiving positions Hp from the alignment positions Ap2 (step S16), and finishes the post-processing operation.

Thus, the post-processing apparatus B according to the present invention is to set the alignment mechanisms 35 and 38 in the preliminary alignment positions Ap1 before shifting to the alignment positions Ap2, and beforehand perform width-alignment on a sheet that has not arrived at the regulation stopper 29. In this case, for a long sheet such as A3 longitudinal such that the sheet is over both the processing tray 25 and the stack tray 30 and that the center of gravity is close to the stack tray 30, the alignment mechanism 38 on the stack tray 30 side performs width-alignment in the preliminary alignment positions Ap1, and for a sheet such as A4 transverse such that the center of gravity is close to the processing tray 25 and that the side in the transport direction is short, the alignment mechanism 35 on the processing tray 25 side performs width-alignment in the preliminary alignment positions Ap1. Then, after the width-alignment in the preliminary alignment positions Ap1, when the sheet arrives at the regulation stopper 29, the alignment mechanism 35 on the processing tray 25 side is shifted to the alignment positions Ap2, and aligns the sheet in its width dimension.

Figure 21:
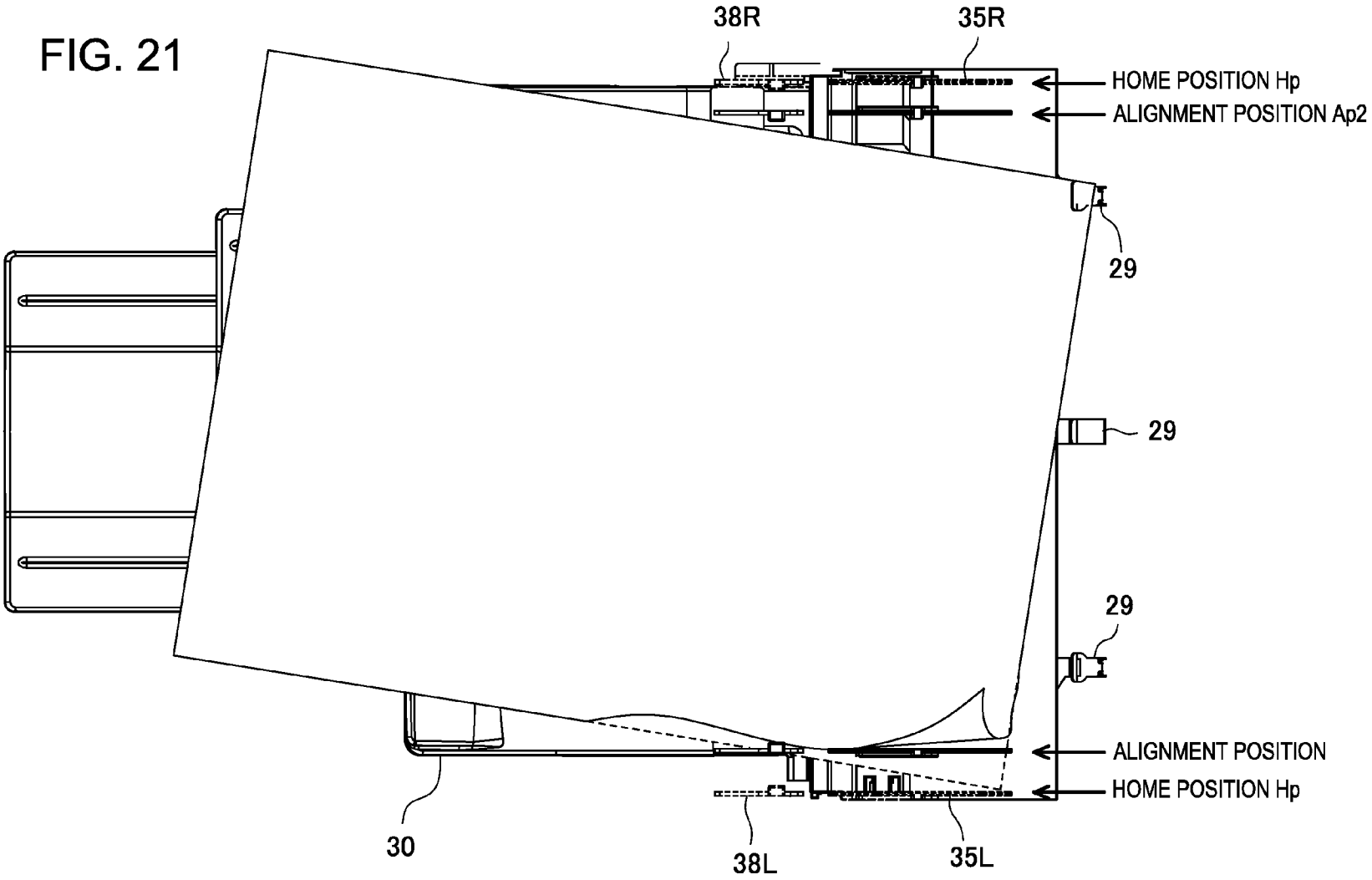
FIG. 21 is an explanatory view illustrating a malfunction that a sheet buckles and arrives at a regulation stopper.

Thus, as shown in FIG. 21, when the alignment mechanisms 35 and 38 are shifted from the sheet receiving positions (home positions) Hp to the alignment positions Ap2 to abruptly perform alignment operation, for a sheet guided to the regulation stopper 29 while being skewed, the front end strikes the alignment plate 35L, and the sheet buckles along the way, then arrives at the regulation stopper 29 while being not aligned, and becomes a cause of a jam. However, by performing once width-alignment in the preliminary alignment positions Ap1 by the alignment mechanism 35 or alignment mechanism 38 corresponding to the center of gravity position of the sheet, the sheet is transported with the skewed state canceled, and after being transported to the regulation stopper 29, is aligned in the alignment positions Ap2 by the alignment mechanism 35.

Described next are Modifications of the above-mentioned control on the alignment mechanisms 35 and 38 by the CPU 50.

Modification 1

According to the flowchart of FIG. 14, the sheet alignment control section 50*b* controls driving of the shift motors MZ1 and MZ2 so that the alignment plates 35R and 35L are in the alignment positions Ap2 (step S8), and then, in the case of the high-speed transport mode, controls driving of the shift motors SM1 and SM2 so as to shift the alignment members 38R and 38L from the preliminary alignment positions Ap1 to the sheet receiving positions Hp (step S12). In contrast thereto, the section 50*b* may control so that the alignment members 38R and 38L are in the sheet receiving positions Hp after transporting the sheet toward the regulation stopper 29 with the reverse roller drive motor 57 i.e. before the alignment plates 35R and 35L are in the alignment positions Ap2.

Figure 15:
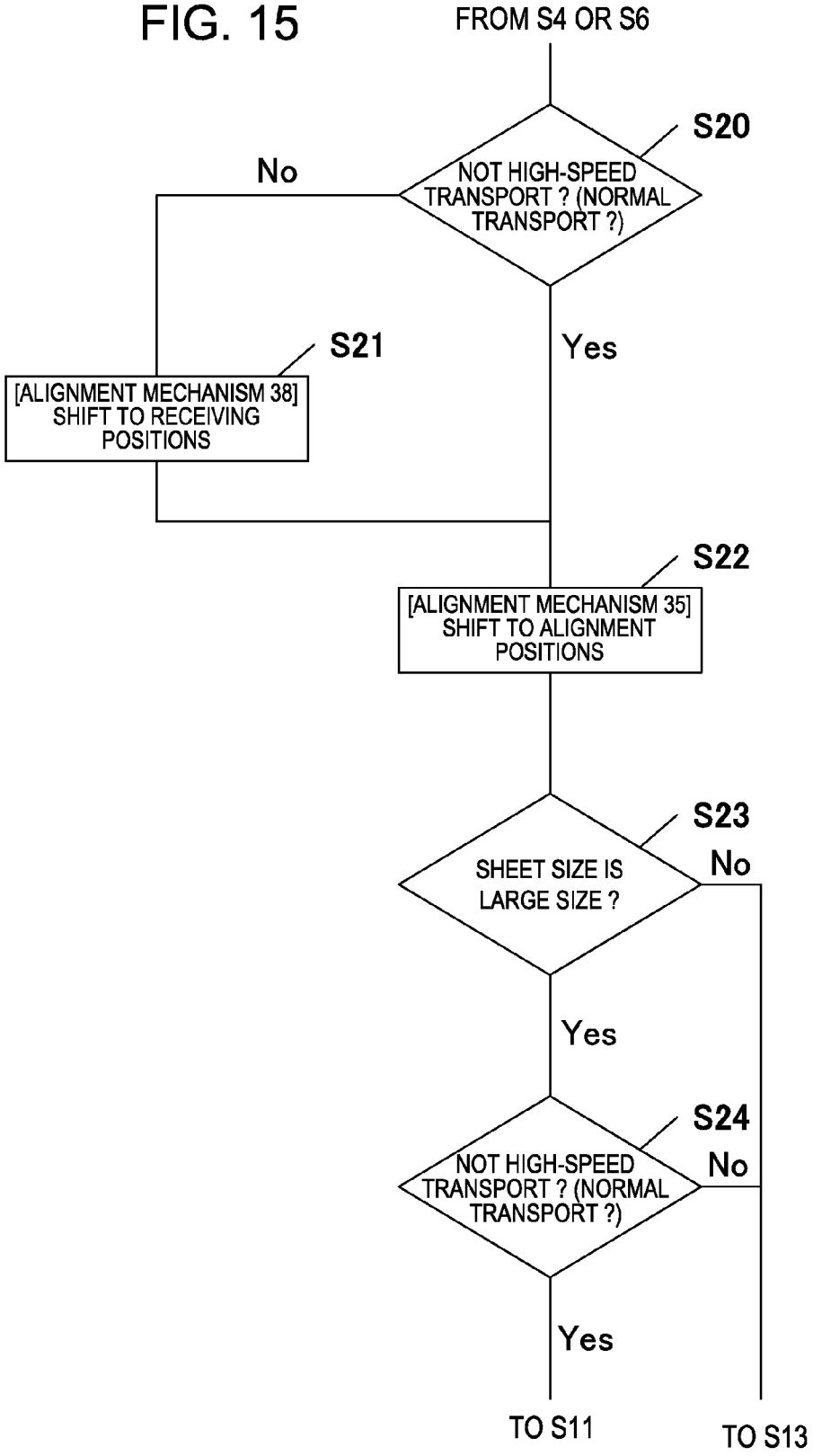
FIG. 15 is a flowchart illustrating Modification 1 of the flowchart of FIG. 14.

FIG. 15 shows a flowchart in this Modification 1. This flowchart is continued from step S4 or step S6 in the flowchart of FIG. 14, and at this point, the reverse roller 32 and take-in roller 33 have started operation of taking in the sheet toward the regulation stopper 29.

In step S20, the sheet alignment control section 50*b* determines whether the mode is the high-speed transport mode. In the case of the high-speed transport mode, the section 50*b* performs processing of step S21, and controls driving of the shift motors SM1 and SM2 so that the alignment members 38R and 38L are from the preliminary alignment positions Ap1 to the sheet receiving positions Hp. As described previously, at this point, when the sheet is not the large size, the processing of step S4 is not executed, and the alignment members 38R and 38L are maintained in the sheet receiving positions Hp from the beginning. On the other hand, when the mode is not the high-speed transport mode, the section 50*b* directly performs processing of step S22.

In step S22, the sheet alignment control section 50*b* controls driving of the shift motors MZ1 and MZ2 so that the alignment plates 35R and 35L are from the preliminary alignment positions Ap1 to the alignment positions Ap2. Accordingly, in the case of the high-speed transport mode, the alignment members 38R and 38L are maintained in the sheet receiving positions Hp before the alignment plates 35R and 35L are in the alignment positions Ap2.

Then, the sheet alignment control section 50*b* checks whether the size of the sheet is the large size (step S23), and determines whether the mode is the high-speed transport mode in the case of the large size (step S24), and the processing of from step S11 as shown in FIG. 14 is performed when the mode is not the high-speed transport mode. On the other hand, when it is checked that the sheet is not the large size in step S23 or it is checked that the mode is the high-speed transport mode in step S24 in the case where the sheet is the large size in step S23, the processing of from step S13 as shown in FIG. 14 is performed.

Modification 2

In the flowchart of FIG. 14, in accordance with the operation (step S8) that the alignment plates 35R and 35L are from the preliminary alignment positions Ap1 to the alignment positions Ap2, the section 50*b* may perform the operation that the alignment members 38R and 38L are from the preliminary alignment positions Ap1 to the sheet receiving positions Hp (step S12).

Figure 16:
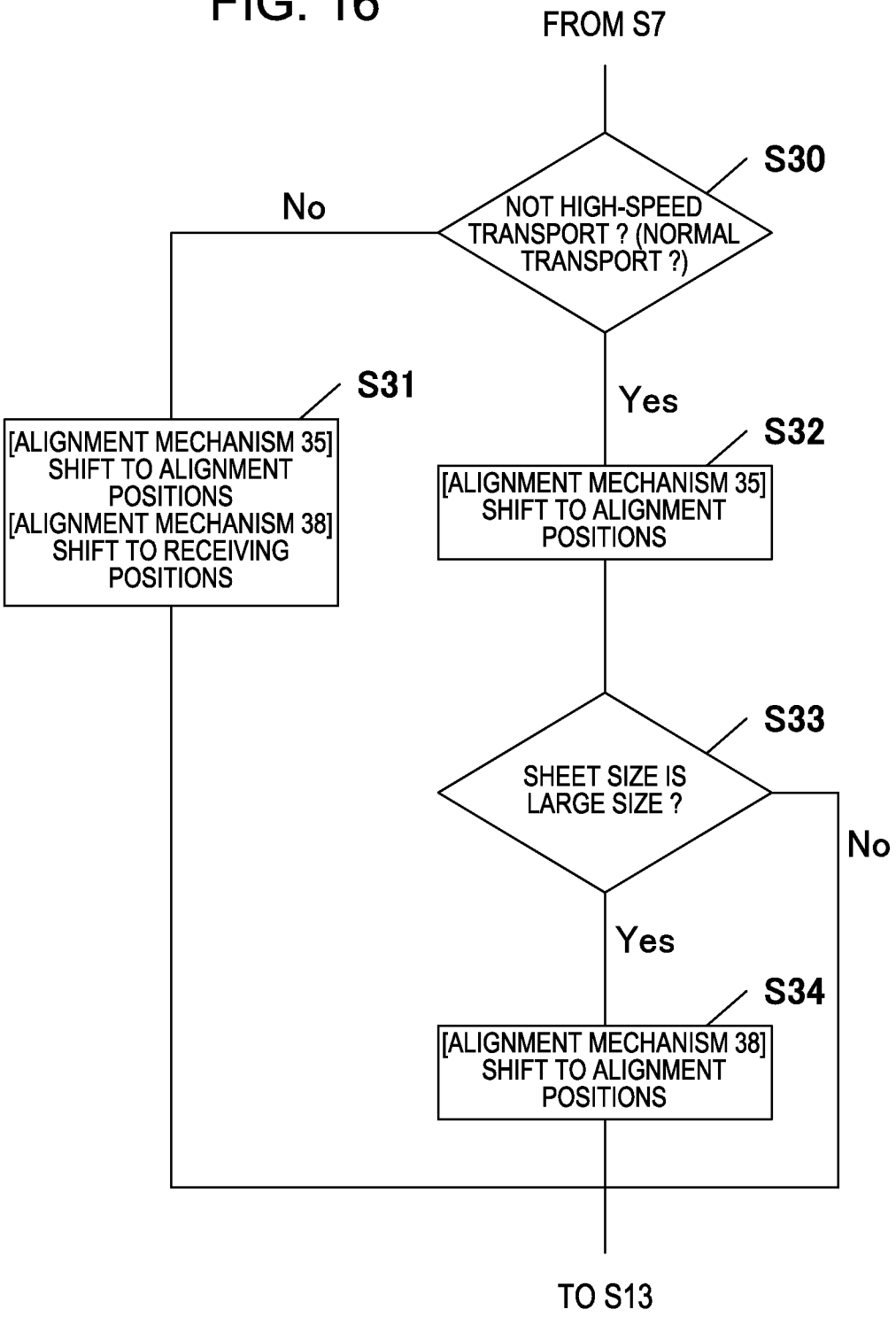
FIG. 16 is a flowchart illustrating Modification 2 of the flowchart of FIG. 14.

FIG. 16 shows a flowchart of this Modification 2. This flowchart is continued from step S7 in the flowchart of FIG. 14.

In step S30, the sheet alignment control section 50*b* determines whether the mode is the high-speed transport mode, and in the case of the high-speed transport mode, the section 50*b* performs processing of step S31, and controls driving of the shift motors MZ1 and MZ2 so that the alignment plates 35R and 35L are from the preliminary alignment positions Ap1 to the alignment positions Ap2, while controlling driving of the shift motors SM1 and SM2 so that the alignment members 38R and 38L are from the preliminary alignment positions Ap1 to the sheet receiving positions Hp. At this point, when the sheet is not the large size, the alignment members 38R and 38L are maintained in the sheet receiving positions Hp from the beginning. Then, the processing of from step S13 as shown in FIG. 14 is performed.

On the other hand, when the mode is not the high-speed transport mode, the sheet alignment control section 50*b* controls driving of the shift motors MZ1 and MZ2 so that the alignment plates 35R and 35L are from the preliminary alignment positions Ap1 to the alignment positions Ap2 (step S32), next checks whether the size of the sheet is the large size (step S33), and in the case of the large size, controls driving of the shift motors SM1 and SM2 so that the alignment members 38R and 38L are from the preliminary alignment positions Ap1 to the sheet receiving positions Hp (step S34). Then, the processing of from step S13 as shown in FIG. 14 is performed.

Modification 3

After executing the post-processing operation (step S14) in the flowchart of FIG. 14, the operation (step 12) may be performed in which the alignment members 38R and 38L are from the preliminary alignment positions Ap1 to the sheet receiving positions Hp.

Figure 17:
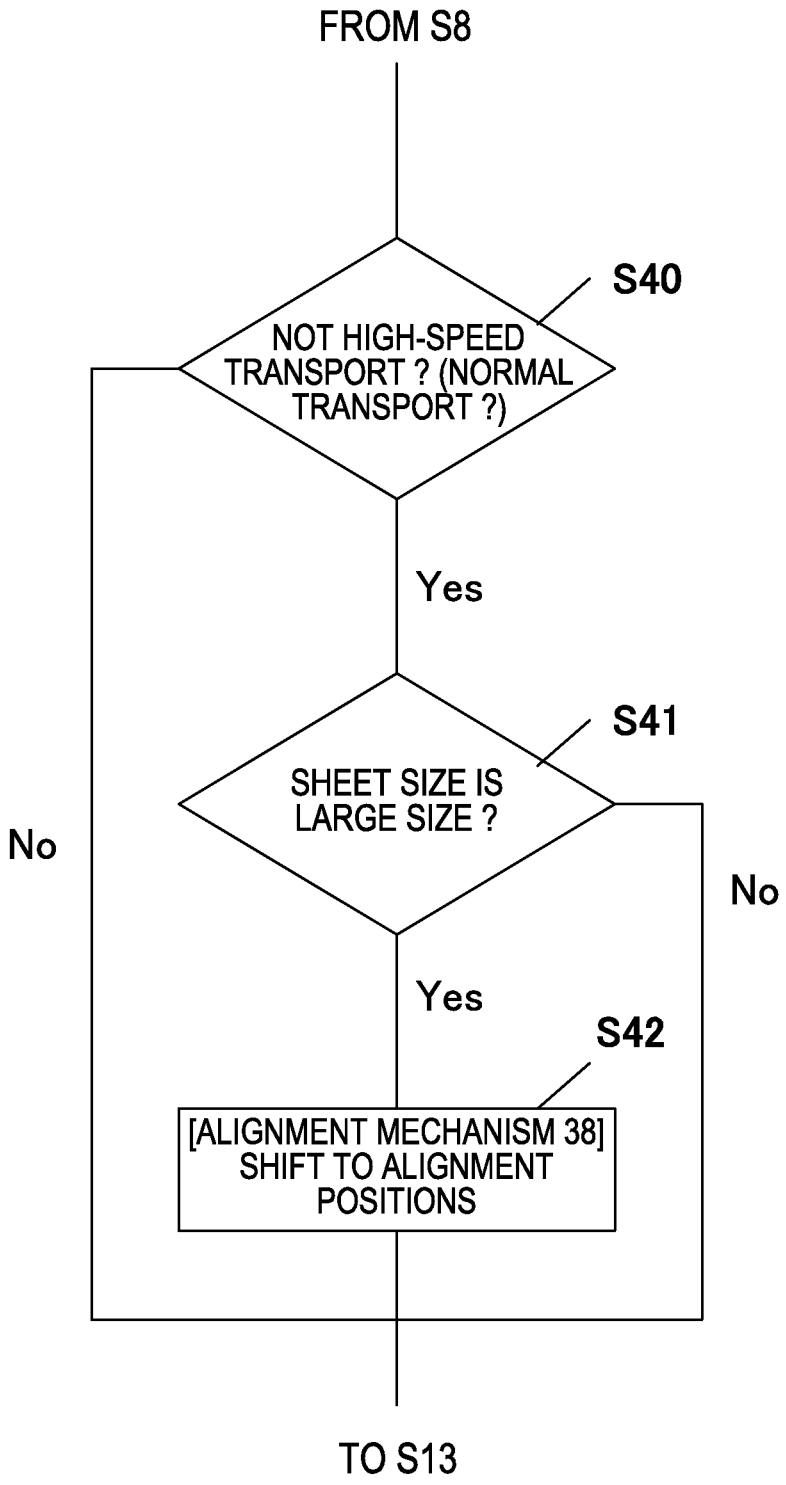
FIG. 17 is a flowchart illustrating Modification 3 of the flowchart of FIG. 14.

FIG. 17 shows a flowchart in Modification 3. This flowchart is continued from step S8 in the flowchart of FIG. 14. In other words, the sheet alignment control section 50*b* controls driving of the shift motors MZ1 and MZ2 so that the alignment plates 35R and 35L are from the preliminary alignment positions Ap1 to the alignment positions Ap2, then determines whether the mode is the high-speed transport mode (step S40), checks whether the size of the sheet is the large size (step S41) when the mode is not the high-speed transport mode, and in the case of the large size, controls driving of the shift motors SM1 and SM2 so that the alignment members 38R and 38L are from the preliminary alignment positions Ap1 to the alignment positions Ap2 (step S42). Then, the processing of from step S13 in the flowchart of FIG. 14 is performed. Accordingly, in the processing of step S15 after the post-processing operation in step S14, the sheet alignment control section 50*b* controls driving of the shift motors SM1 and SM2 so that the alignment members 38R and 38L are in the sheet receiving positions Hp. At this point, when the sheet is not the large size, the alignment members 38R and 38L are maintained in the sheet receiving positions Hp from the beginning.

On the other hand, when it is determined that the mode is the high-speed transport mode (step S40) or when it is checked that the size of the sheet is not the large size (step S41) in the case where the mode is not the high-speed transport mode, without shifting the alignment members 38R and 38L to the alignment positions Ap2, the processing in step S13 is performed. Further, also in the processing of from steps S14 to S15, the alignment members 38R and 38L are maintained in the sheet receiving positions Hp from the beginning.

Modification 4

The alignment operation (step S8) of the alignment plates 35R and 35L and the alignment operation (step S11) of the alignment members 38R and 38L to handle in the flowchart of FIG. 14 may be performed at the same time.

Figure 18:
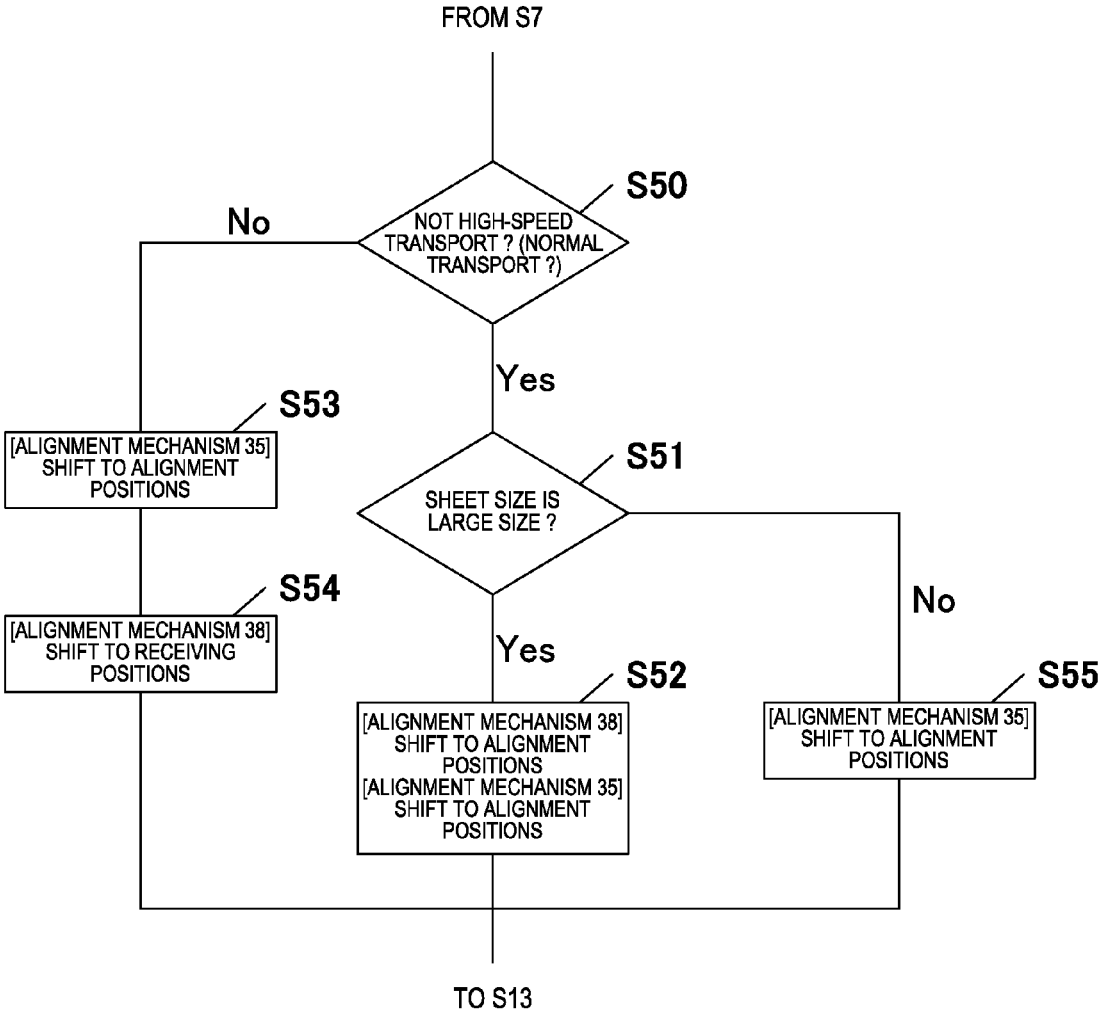
FIG. 18 is a flowchart illustrating Modification 4 of the flowchart of FIG. 14.

FIG. 18 shows a flowchart of this Modification 4. This flowchart is continued from step S7 in the flowchart of FIG. 14. In step S50, the sheet alignment control section 50*b* determines whether the mode is the high-speed transport mode, and when the mode is not the high-speed transport mode, checks whether the size of the sheet is the large size in step S51. Then, in the case of the large size, in step S52, the sheet alignment control section 50*b* controls driving of the shift motors MZ1 and MZ2 so that the alignment plates 35R and 35L are from the preliminary alignment positions Ap1 to the alignment positions Ap2, while controlling driving of the shift motors SM1 and SM2 so that the alignment members 38R and 38L are in the alignment positions Ap2. In addition, at this point, when the sheet is the large size, the alignment members 38R and 38L are already shifted to the preliminary alignment positions Ap1 by the processing in step S2, and therefore, are shifted from the preliminary alignment positions Ap1 to the alignment positions Ap1. Then, the processing of from step S13 in the flowchart of FIG. 14 is performed.

On the other hand, when the sheet alignment control section 50*b* determines that the mode is the high-speed transport mode in step S50, the section 50*b* controls driving of the shift motors MZ1 and MZ2 so that the alignment plates 35R and 35L are from the preliminary alignment positions Ap1 to the alignment positions Ap2 (step S53), and controls driving of the shift motors SM1 and SM2 so that the alignment members 38R and 38L are in the sheet receiving positions Hp (step S54). At this point, when the sheet is not the large size, the alignment members 38R and 38L are maintained in the sheet receiving positions Hp from the beginning. Then, the processing of from step S13 in the flowchart of FIG. 14 is performed.

Further, when the sheet alignment control section 50*b* determines that the sheet is not the large size in step S51, the section 50*b* controls the shift motors MZ1 and MZ2 so that the alignment plates 35R and 35L are from the preliminary alignment positions Ap1 to the alignment positions Ap2 (step S55), and the processing of from step S13 in the flowchart of FIG. 14 is performed.

Accordingly, in Modification 4, when the mode is the normal transport mode and the sheet is the large size, the alignment operation of the alignment plates 35R and 35L and the alignment operation of the alignment members 38R and 38L is performed at the same time.

Modification 5

In the flowchart of FIG. 14, the alignment plates 35R and 35L may perform the alignment operation (step S8) after the alignment members 38R and 38L perform the alignment operation (step S11).

FIG. 19 shows a flowchart of this Modification 5. This flowchart is continued from step S7 in the flowchart of FIG. 14. In step S60, the sheet alignment control section 50*b* determines whether the mode is the high-speed transport mode, and when the mode is not the high-speed transport mode, checks whether the size of the sheet is the large size in step S61. Then, in the case of the large size, in step S62, the sheet alignment control section 50*b* controls driving of the shift motors SM1 and SM2 so that the alignment members 38R and 38L are in the alignment positions Ap2. In addition, at this point, when the sheet is the large size, the alignment members 38R and 38L are already shifted to the preliminary alignment positions Ap1 by the processing in step S2, and therefore, are shifted from the preliminary alignment positions Ap1 to the alignment positions Ap1.

Then, in step S63, the sheet alignment control section 50*b* controls driving of the shift motors MZ1 and MZ2 so that the alignment plates 35R and 35L are from the preliminary alignment positions Ap1 to the alignment positions Ap2, and then, the processing of from step S13 in the flowchart of FIG. 14 is performed.

On the other hand, when the sheet alignment control section 50*b* determines that the mode is the high-speed transport mode in step S60, the section 50*b* controls driving of the shift motors SM1 and SM2 so that the alignment members 38R and 38L are in the sheet receiving positions Hp (step S64). At this point, when the sheet is not the large size, the alignment members 38R and 38L are maintained in the sheet receiving positions Hp from the beginning. Then, the processing of from step S13 in the flowchart of FIG. 14 is performed.

Further, when the sheet alignment control section 50*b* determines that the sheet is not the large size in step S61, the section 50*b* controls the shift motors MZ1 and MZ2 so that the alignment plates 35R and 35L are from the preliminary alignment positions Ap1 to the alignment positions Ap2 (step S65), and the processing of from step S13 in the flowchart of FIG. 14 is performed.

Accordingly, in Modification 5, when the mode is the normal transport mode and the sheet is the large size, the alignment operation of the alignment plates 35R and 35L is performed after performing the alignment operation of the alignment members 38R and 38L.

In addition, this application claims priority from Japanese Patent Application No. 2013-146633 incorporated herein by reference.

What is claimed is:

1. A sheet post-processing apparatus comprising:

a sheet discharge path having a sheet discharge outlet;

a transporter for transporting a sheet along the sheet discharge path;

a processing tray to store sheets transported from the sheet discharge outlet and to make a bunch of sheets;

a regulation stopper that comes into contact with a rear end portion in a transport direction of the sheet transported to the processing tray by the transporter;

a sheet take-in device for taking in the sheet transported onto the processing tray toward the regulation stopper;

a first alignment device having a pair of first alignment members to perform alignment operation for the sheet arriving at the regulation stopper from the sheet discharge outlet, that is alignment with a distance between the pair of first alignment members substantially equal to a dimension of the sheet in a width direction orthogonal to the transport direction;

a second alignment device having a pair of second alignment members disposed on a downstream side of the first alignment device in the transport direction of the sheet, to perform the alignment operation, for the sheet arriving at the regulation stopper from the sheet discharge outlet, that is alignment with a distance between the pair of second alignment members substantially equal to a dimension of the sheet in the width direction orthogonal to the transport direction;

a sheet post-processing device for performing predetermined post-processing on the bunch of sheets on the processing tray;

a discharger for discharging the bunch of sheets subjected to the post-processing from the processing tray;

a stack tray that collects the bunch of sheets subjected to the post-processing discharged by the discharger; and a controller for controlling operation of the first alignment device and the second alignment device, wherein when the sheet take-in device performs take-in operation, the controller causes at least one of the first alignment device and the second alignment device to perform preliminary alignment operation that is alignment with a distance longer than a dimension of the sheet in the width direction, corresponding to size information of the sheet transported to the processing tray from the sheet discharge outlet.

2. The sheet post-processing apparatus according to claim 1, wherein after the sheet that is transported to the processing tray arrives at the regulation stopper, the controller causes the first alignment device to perform alignment operation that is alignment with a distance substantially equal to the dimension in the width direction of the sheet.

3. The sheet post-processing apparatus according to claim 1, wherein a transport speed by the transporter is capable of being switched to a high-speed transport mode, and in the high-speed transport mode, the controller makes the second alignment device a receiving state capable of receiving the sheet after having caused the second alignment device to perform the preliminary alignment operation.

4. The sheet post-processing apparatus according to claim 3, wherein after the first alignment device finishes the alignment operation of the sheet, the controller makes the second alignment device the sheet receiving state.

5. The sheet post-processing apparatus according to claim 3, wherein after the sheet take in device slants take-in operation, the controller makes the second alignment device the receiving state.

6. The sheet post-processing apparatus according to claim 3, wherein the controller makes the second alignment device the receiving state, in accordance with the alignment operation by the first alignment device.

7. The sheet post-processing apparatus according to claim 3, wherein after the post-processing device finishes post-processing operation, the controller makes the second alignment device the receiving state.

8. The sheet post-processing apparatus according to claim 2, wherein after causing the first alignment device to perform the alignment operation, the controller causes the second alignment device to perform the alignment operation.

9. The sheet post-processing apparatus according to claim 2, wherein after the sheet that is transported to the processing tray arrives at the regulation stopper, the controller causes the second alignment device to perform the alignment operation together with the first alignment device.

10. The sheet post-processing apparatus according to claim 2, wherein after causing the second alignment device to perform the alignment operation, the controller causes the first alignment device to perform the alignment operation.

11. The sheet post-processing apparatus according to claim 8, wherein in discharging the sheet to the stack tray, the controller makes the second alignment device a sheet receiving state to receive the sheet.

12. The sheet post-processing apparatus according to claim 11, wherein after making the second alignment device the receiving state, the controller makes the first alignment device the receiving state.

13. The sheet post-processing apparatus according to claim 1, wherein after causing the second alignment device to perform the preliminary alignment operation, the controller causes the first alignment device to perform the preliminary alignment operation.

14. The sheet post-processing apparatus according to claim 1, wherein the first alignment device is provided with a pair of right and left alignment plates at least one of which shifts to positions in the sheet width direction orthogonal to the transport direction of the sheet.

15. The sheet post-processing apparatus according to claim 1, wherein the second alignment device is provided with a pair of right and left alignment members at least one of which shifts to positions in the sheet width direction orthogonal to the transport direction of the sheet, and each of the alignment members has a sheet support surface that supports a lower surface of the sheet transported from the sheet discharge outlet to the processing tray, and a side regulation surface that aligns a side end surface of the sheet transported onto the processing tray in a predetermined processing position.

16. The sheet post-processing apparatus according to claim 15, further comprising:

a height-direction shift device for moving at least one of the alignment members up and down in a height direction, wherein the controller controls the height-direction shift device so that the sheet support surface is in a first height position in transporting the sheet from the sheet discharge outlet to the processing tray, and that the sheet support surface is in a second height position in transporting the sheet from the processing tray to the stack tray.

17. The sheet post-processing apparatus according to claim 16, wherein the sheet support surface supports the sheet in a height posture almost the same as a paper mount surface of the processing tray in the first height position, and supports the sheet in a curved posture downward from the paper mount surface of the processing tray in the second height position.

18. The sheet post-processing apparatus according to claim 17, wherein the alignment members are axially supported swingably between the first and second height positions.

19. The sheet post-processing apparatus according to claim 16, wherein the alignment members are configured to be able to move up and down corresponding to a load amount of an uppermost sheet on the stack tray so as to press a surface of the uppermost sheet on the stack tray in a state of the first height position.

20. The sheet post-processing apparatus according to claim 16, wherein the controller controls the height-direction shift device, and enables the alignment members to shift to a third height position retracted from any shift trajectory of the sheet which is transported from the sheet discharge outlet to the processing tray or which is transported from the processing tray to the stack tray.

21. An image formation system comprising:

an image formation apparatus that forms an image on a sheet; and a sheet post-processing apparatus that performs post-processing on the sheet transported from the image formation apparatus to store in a stack tray, wherein the sheet post-processing apparatus is the sheet post-processing apparatus according to claim 1.

22. The sheet post-processing apparatus according to claim 1, wherein the first alignment device is disposed on a side portion of the processing tray to the second alignment device, and the second alignment device is arranged above the stack tray arranged on the downstream side of the processing tray in the transport direction.

23. The sheet post-processing apparatus according to claim 22, wherein the pair of second alignment members are a pair of right and left alignment members having side regulation surfaces facing each other for aligning the sheet in the direction orthogonal to the transport direction of the sheet, and each of the side regulation surfaces includes a first side regulation surface aligning the sheet on the processing tray, and a second side regulation surface situated under the first side regulation surface and aligning the sheet on the stack tray.

24. The sheet post-processing apparatus according to claim 23, wherein the pair of right and left alignment members further includes sheet support surfaces extending toward each other for supporting the sheet, each of the sheet support surfaces extends from the first side regulation surface in a direction perpendicular to the side regulation surface to connect to the second side regulation surface, and a distance between the first side regulation surfaces of the pair of right and left alignment members is greater than a distance between the second side regulation surfaces of the pair of right and left alignment members.

* * * * *